US006437275B1

(12) United States Patent
Kikuchi et al.

(10) Patent No.: US 6,437,275 B1
(45) **Date of Patent: *Aug. 20, 2002**

(54) VACUUM CIRCUIT-BREAKER, VACUUM BULB FOR USE THEREIN, AND ELECTRODES THEREOF

(75) Inventors: Shigeru Kikuchi, Ibaraki-ken; Masato Kobayashi, Hitachi; Katsuhiro Komuro, Hitachi; Toru Tanimizu, Hitachi; Yoshimi Hakamata, Hitachi; Kathumi Kuroda, Hitachi; Hitoshi Okabe, Hitachi; Noboru Baba, Hitachiota, all of (JP)

(73) Assignee: Hitachi, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/188,366

(22) Filed: Nov. 10, 1998

(51) Int. Cl.[7] ..... H01H 33/66
(52) U.S. Cl. ..... 218/123; 218/118; 218/130
(58) Field of Search ..... 218/118, 121–128, 218/130; 29/854

(56) References Cited

U.S. PATENT DOCUMENTS

| | | | | |
|---|---|---|---|---|
| 3,828,428 A | | 8/1974 | Wayland | |
| 4,440,995 A | * | 4/1984 | Lange et al. | 218/118 |
| 4,743,718 A | | 5/1988 | Santilli | |
| 4,926,017 A | * | 5/1990 | Aoki et al. | 218/118 |
| 5,059,752 A | * | 10/1991 | Inagaki | 218/118 |
| 5,500,499 A | * | 3/1996 | Seki et al. | 218/130 |
| 5,557,083 A | * | 9/1996 | Komuro et al. | 218/125 |
| 5,612,523 A | * | 3/1997 | Hakamata et al. | 218/132 |
| 5,763,848 A | * | 6/1998 | Hakamata et al. | 218/128 |
| 5,804,788 A | * | 9/1998 | Smith | 218/129 |
| 5,952,636 A | * | 9/1999 | Morita et al. | 218/118 |

FOREIGN PATENT DOCUMENTS

| | | |
|---|---|---|
| JP | 50-21670 | 7/1975 |
| JP | 60-56321 | 4/1985 |
| JP | 63-96204 | 4/1988 |
| JP | 4-43521 | 2/1992 |
| JP | 5-120948 | 5/1993 |
| JP | 7-29461 | 1/1995 |

OTHER PUBLICATIONS

Database WPI, Section El, Week 9710, Derwent Publications Ltd., London, GB; Class X13, AN 97–107019, XP002104631 & RU 2063087 C (Tovarishchestvo S Ogranichenno), Jun. 27, 1996.

* cited by examiner

*Primary Examiner*—Lincoln Donovan
(74) *Attorney, Agent, or Firm*—Mattingly, Stanger & Malur, P.C.

(57) ABSTRACT

The invention aims at providing a vacuum circuit-breaker, a vacuum valve used therein and electrodes for the vacuum valve, which can reduce the manufacturing cost while being of high performance and compact in size. The invention resides in a vacuum circuit-breaker, a vacuum valve and electrodes for the vacuum valve, which are characterized in that fixed and movable electrodes each comprise arc electrodes, whose entire surfaces, mutually facing each other, are made of an alloy containing a refractory metal and a highly conductive metal, and electrode rods of a highly conductive metal supporting the respective arc electrodes, and that each arc electrode and the mating electrode rod are integrally formed by means of solid-phase diffusion bonding.

15 Claims, 17 Drawing Sheets

VACUUM CIRCUIT-BREAKER, VACUUM BULB FOR USE THEREIN, AND ELECTRODES THEREOF

BACKGROUND OF THE INVENTION

The present invention relates to a novel vacuum circuit-breaker, to a vacuum valve for use in the circuit-breaker, and furthermore to electrodes which are used therein.

An electrode arrangement in a vacuum circuit-breaker comprises a pair of a stationary or fixed electrode and a movable electrode. Each of the above fixed and movable electrodes comprises four individual elements of an arc electrode, an arc electrode support which supports the arc electrode, a coil electrode material which extends from the arc supporter, and an electrode rod at the end of the coil electrode.

The above arc electrode is directly exposed to arc when breaking a high voltage and a large current. Desirable characteristics required for the arc electrode are fundamental requirements such as a large current breaking capacity, a high voltage resistance, a low contact resistance (i.e., an excellent electrical conductivity), an excellent fusion resistance, a low contact wear, and a low cutting current value. It is difficult, however, to satisfy all of the above requirements, and hence, in general, there has been used a material in which given preference are the characteristics considered to be particularly important for a specific use, and the other characteristics are sacrificed to some extent. As an arc electrode material for large current and high voltage break, Japanese Patent Application Laid-Open Publication No. 96204/1988 teaches a method of dissolving Cu in Cr or a Cr—Cu skeleton. Furthermore, a similar manufacturing method has also been disclosed in Japanese Patent Post-Examination Publication No. 21670/1975.

The electrode arrangement in a vacuum valve which is located in a vacuum circuit-breaker also comprises a pair of electrodes constituted by a fixed electrode and a movable electrode. Each of the fixed electrode and the movable electrode comprises an electrical contact and an electrode rod extending therefrom, and a plate of a stainless steel or the like is often provided as a reinforcing plate on the back side of the electrical contact.

Cr—Cu composite metals or Cr—Cu composite with small additions of other elements such as W, Co, Mo, V and Nb are frequently used as the materials for the electrical contacts for large current and high voltage break.

The above electrical contacts are manufactured by forming the constituent metal powders or mixture thereof into a compact with predetermined composition, shape, and hole volume. The compact thus formed is subsequently sintered to form a skeleton into which Cu or an alloy flux thereof is forced to permeate by a so-called infiltration method. Alternatively, the compact is given high density in the pre-infiltration sintering process by a so-called powder metallurgy method. The electrical contacts obtained in this manner are further machined into the desired shape.

On the other hand, the electrode rod is formed by cutting a pure Cu material into a predetermined shape.

After each of the elements manufactured as described above is assembled, brazing is performed, thereby combining the elements into individual electrode structures. However, electrodes which are constructed through brazing requires excessive time and effort for assembly due to machining and brazing for every element, and furthermore, brazing deficiencies will lead to electrode breakage or fall-off.

As a solution to the above problems, a so-called one-piece infiltration method has been developed, by which the above electrical contact and electrode rod are combined into one unit in the manufacturing stage. More specifically, a highly conductive metal for forming the electrode rod is placed and held on a skeleton which has been formed to the required composition, shape, and hole volume from the mixed powder of components for the electrical contact. The assembly is heated to infiltrate the highly conductive metal into the electrical contact and to form the electrode rod with the remaining highly conductive metal. This method is disclosed in Japanese Patent Application Laid-Open Publication No. 29461/1995.

SUMMARY OF THE INVENTION

According to the one-piece infiltration method, pre-brazing assembling operations and brazing operations become unnecessary to remarkably reduce the production stages, and furthermore, electrode breakage or fall-off caused by brazing deficiencies is eliminated, thereby providing electrodes of superior reliability and safety. On the other hand, there occurs consumption of the electrical contact component to a certain degree into the electrode rod side due to dispersion and solidification. The skeleton of the electrical contact therefore has to be formed larger by the consumed volume, thus increasing the manufacture cost. Furthermore, the consumed volume of the electrode varies widely due to non-uniformity in composition and hole volume of the skeleton. Consequently, there occurs an irregularity in position of the interface between the electrical contact and the electrode rod, and the manufacturing yield deteriorates.

Further, large ingot piping occurs in the upper portion of post-infiltration ingots. The electrode has to be cut from the material excepting the ingot piping, and the material is largely wasted.

The electrical contact described above is provided with slit grooves for imparting a driving force to arcs generated, thereby moving the arcs to the periphery of the electrode and preventing the arcs from stagnating. The slit grooves divide the electrical contact into vane-shaped segments. These slit grooves are machined with end mills, etc. after the infiltration process. The machining takes much time because the grooves are in a curved shape.

Moreover, there arise further problems that assembling for joining the manufactured electrical contact to the electrode rod requires time, and that because of the use of brazing flux and the necessity of brazing, associated costs are incurred. In addition, application of heat during the brazing causes vaporization of the brazing flux which subsequently adheres to the contact surface, thereby resulting in instability of the current breaking performance.

An object of the invention is to provide a vacuum circuit-breaker, a vacuum valve used in the circuit-breaker and electrodes for the vacuum valve, which can reduce the manufacturing process while being of high performance and compact in size.

The invention features a vacuum circuit-breaker comprising a vacuum valve which has fixed and movable electrodes in a vacuum container, conductive terminals for connecting the respective fixed and movable electrodes in the vacuum valve to the outside thereof, and switching means for driving the movable electrode, wherein the fixed and movable electrodes each comprise arc electrodes, whose entire surfaces, mutually facing each other, are made of an alloy containing a refractory metal and a highly conductive metal, and electrode rods of a highly conductive metal supporting the respective arc electrodes, and each arc electrode and the mating electrode rod are integrally formed by means of solid-phase diffusion bonding, preferably simultaneously with the formation of the arc electrode through sintering.

Further, the invention resides in a vacuum circuit-breaker which is characterized in that the fixed and movable electrodes each have a plurality of grooves which are formed in their surfaces facing each other from the inner sides thereof to the outsides except central portions of the electrodes. Each groove penetrates completely the arc electrode, and a recess is formed in the central portion of the surface of each electrode.

Furthermore, the invention resides in a vacuum valve having the fixed and movable electrodes described above and also in vacuum-valve electrodes comprising these electrodes.

The invention is directed to the vacuum valve having a pair of fixed and movable electrodes in a vacuum container, preferably a cylindrical insulation container, wherein the fixed and movable electrodes comprise compacts serving as arc electrodes, each of which is made through the pressure formation of a shaped body from an alloy powder of a refractory metal and a highly conductive metal, or a powder mixture of a refractory metal powder and a highly conductive metal powder, and each of which is in a shape having vanes or blades separated preferably by slit grooves and a central recess. Each compact is coupled to the electrode rod of the construction described above, which is formed from a highly conductive metal or alloy and has a protrusion on the central axis thereof, with the protrusion of the electrode rod fitted into the recess of the compact. They are heated to a temperature below the melting point of the highly conductive metal to sinter the compact and simultaneously join the electrode and the electrode rod into a metallurgically-bonded unit by solid-phase diffusion bonding.

A reinforcing plate, which is made of austenitic stainless-steel plate and has a central hole, is provided on the rear side of the arc electrode. The reinforcing plate is positioned between the compact and the electrode rod, and the protrusion of the electrode rod is inserted in the reinforcing plate. The reinforcing plate is fixed to the rear side of the arc electrode by means of diffusion bonding through heating simultaneous with the sintering of the arc electrode.

The refractory metal contained in the above compact is preferably one of the following or is a mixture or compound of two or more of the following: Cr, W, Mo, Ta, Nb, Be, Hf, Ir, Pt, Zr, Ti, Fe, Co, Si, Rh, or Ru. Similarly, the highly conductive metal is preferably Cu, Ag, Au, or an alloy having the main constituent of Cu, Ag, or Au.

It is preferable that the alloy powder of the refractory metal and the highly conductive metal, or the powder mixture of the refractory metal powder and the highly conductive metal powder, contains 15% to 40% by weight of the refractory metal, and 60% to 85% by weight of the highly conductive metal.

Furthermore, it is favorable that the particle size of the alloy powder of the refractory metal and the highly conductive metal, or of the powder mixture of the refractory metal powder and the highly conductive metal powder is 104 $\mu$m or less. With regard to the tolerance of fitting of the protrusion on the electrode rod into the recess in the compact, a tolerance in the range of 0.5% to 4% of the recess dimension is desirable when the particle diameter of the alloy powder or powder mixture is between 61 $\mu$m and 104 $\mu$m inclusive. A tolerance in the range of 1.5% to 9% of the recess dimension is desirable when the particle diameter of the alloy powder or powder mixture is 60 $\mu$m or smaller.

It is desirable that the arc electrode and the electrode rod, which are metallurgically bonded into an integrated element by sintering of the above compact, have a pull-apart strength of no less than 200 kgf or more in the direction of insertion. With this strength, it can be ensured that disconnection of the arc electrode at the bonded section can be prevented even when it fuses with the mating electrode.

Each vacuum-valve electrode according to the invention comprises the arc electrode and the above-mentioned electrode rod extending therefrom, in which arc electrode are provided slit grooves of a curved shape for moving arcs generated. The arc electrode is divided into preferably vane or blade-shaped sections by the grooves. The slit grooves can be realized in a quick and simple manner by pressure forming of a charge of the material powder of the arc electrode in a die which is capable of forming a vane-type structure with slit grooves. By sintering the vane-type compact thus formed at a temperature lower than the melting point of the high-conductivity-metal constituent contained therein, it is possible to realize the arc electrode while the vane-type configuration with the above slit grooves remains intact. With this process, the grooves require no machining after the sintering, thereby enabling a remarkable reduction of the processing time. The outer ends of the slit grooves may be kept uncut during the formation and sintering and be cut through outer-edge machining after the sintering, thereby preventing distortion due to sinter shrinkage.

The recess is formed in the center of the above compact by die formation. The recess, when sintering with the protrusion. on the central axis of the arc electrode fitted therein, comes into a so-called shrinkage fit condition due to the shrinkage and solid-phase diffusion bonding of the compact, so that the arc electrode and the electrode rod are metallurgically bonded into one unit in the sintering process. With this process, a brazing stage becomes unnecessary, no use of brazing flux prevents defects in the joint due to the heat of the arc upon current breaking, and furthermore, the current breaking performance can be prevented from deteriorating due to scattering of components of the brazing flux.

Although the arc electrode of the invention is made of the alloy containing the refractory metal and the high conductivity metal, it may have a layer or stratum of only the highly conductive metal on the electrode-rod side to thereby allow the electrical resistance of the arc electrode to be lowered and the material costs to be reduced. Also, the reinforcing plate of austenitic stainless-steel is provided on the rear side of the arc electrode to prevent deformation of, or damage to, the arc electrode as a result of impact during electrode opening and closing. The central hole of the reinforcing plate has the same shape and size as those of the recess in the compact, and can be affixed to the rear of the electrical contact through sintering while being positioned between the compact and the electrode rod and fitted to the protrusion of the electrode rod.

A formation pressure for the above compact is preferably 1.5 ton/cm$^2$ to 4 ton/cm$^2$. If the formation pressure is smaller than this range, the density of the formed compact would be reduced, and the compact would tend to break. On the other hand, if the formation pressure is larger than the above range, the formed compact would have an increased density and be difficult to join to the electrode rod because the shrinkage during sintering is reduced.

By setting the compounding ratio of the refractory metal and the highly conductive metal at 15% to 40% by weight of the refractory metal and 60% to 80% by weight of the highly conductive metal, it is possible to realize a vacuum valve which is excellent in current breaking performance and voltage resistance characteristics while having a relatively low electrical resistance.

Furthermore, by setting the particle size of the material powder containing the refractory metal and the highly conductive metal at 104 μm or less, the surface of the electrical contact has a uniformly fine structure; excellent current breaking performance, voltage resistance, and fusion resistance can be realized; and the shrinkage of the compact increases to enable it to be joined to the electrode rod firmly. If the material powder has a poor flow characteristic and is hardly charged in the die, an appropriate binder may be added to make it in granular form by means of spray drying, etc. In addition, the protrusion on the electrode rod and the recess in the compact can be placed in an appropriate joining condition by setting the tolerance of fitting at a value within the range of 0.5% to 4% of the recess size when the particle diameter of the material powder of the compact is between 61 μm and 104 μm and at another value within the range of 1.5% to 9% when the particle size is 60 μm or smaller. In other words, if the fitting tolerance is smaller than the above range, shrinkage of the compact would be inhibited to thereby make it impossible to obtain a sound sintered element. On the other hand, if the fitting tolerance is larger than the above range, the effectiveness of shrink-fitting on the protrusion of the electrode rod would be diminished, thereby rendering it impossible to obtain sufficient joint strength.

The invention is directed to a vacuum circuit-breaker comprising a vacuum valve with fixed and movable electrodes in a vacuum container, which is preferably an insulation container, conductive terminals connecting the respective fixed and movable electrodes in the vacuum valve to the outside thereof, and switching means for driving the movable electrode preferably through an insulation rod connected thereto. Each of the fixed and movable electrodes comprises an arc electrode made of an alloy containing refractory metal particles, a highly conductive metal and preferably a low-melting-point metal; an electrode support of a highly conductive metal supporting the arc electrode; and an electrode rod of a highly conductive metal having a rear conductor smaller in diameter than the electrode support and an external connection conductor larger in diameter than the rear conductor.

The electrode support and the electrode rod are formed into one unit simultaneously with sintering or by solid-phase diffusion bonding.

For the arc electrodes and the electrode supports, the refractory metal particles are preferably contained at the following percentages by weight with respect to the complete refractory metal: 5% or less for particle sizes of more than 140 μm; 45% to 90% for particle sizes of 70 μm to 140 μm; 7% to 35% for particle sizes of 40 μm to 70 μm; and 0.5% to 15% for particle sizes of less than 40 μm.

The arc electrodes particularly preferably comprise one of or a mixture of Cr, W, Mo and Ta which have melting points of 1800° C. or more among the above refractory metals and in which the amount of a dissolved metal is 3% by weight or less based on the weight of Cu, a composite material of the highly conductive metal comprising one of Cu, Ag and Au, or the highly conductive alloy mainly comprising these highly conductive metals. The above electrode support preferably comprises the above highly conductive metal or alloy.

Furthermore, the arc electrodes preferably comprise a composite material of 15 to 40% by weight of the total amount of one or more of Cr, W, Mo and Ta as the refractory metals and 40 to 85% by weight of one of Cu, Ag and Au as the highly conductive metals, or an alloy mainly comprising the highly conductive metals. Moreover, the above electrode support, the rear conductor and the external conductor connection preferably each comprise an alloy of 2.5% by weight or less, preferably 0.5 to 2.5% by weight of the total amount of one or more of Cr, Ag, W, V, Nb, Mo, Ta, Zr, Si, Be, Ti, Co and Fe, and Cu, Ag or Au, so that loading endurance can be remarkably improved. As a result, the thus obtained arc electrode can sufficiently withstand an increase in the contact pressure between the electrodes and an impact force at the time of opening/closing of the electrodes, and it can also inhibit a deformation with time. Particularly, in the case that a rated voltage is 10 kV or less, the content of the refractory metal is preferably in the range of 15 to 40% by weight, and in the case that it is more than 10 kV, the content of the refractory metal is preferably in the range of 40 to 60% by weight.

The arc electrode in the invention comprises the composite alloy of the refractory metal and the highly conductive metal, and the arc electrode and the electrode rod are integrally formed by sintering or solid-phase diffusion bonding at the time of formation of the arc electrode.

The electrode support in the invention preferably has a 0.2% stress of 10 kg/mm$^2$ or more and a relative resistance of 2.8 μΩcm or less.

In a further feature of the invention, the fixed and movable electrodes each have circular recesses formed in the centers of their arc electrodes that mutually contact each other.

The arc electrode and the electrode support are formed by sintering of powder metallurgy, and simultaneously the electrode rod is integrally formed by solid phase diffusion bonding.

The number of the slit grooves described above is plural, preferably in the range of 3 to 6, and they each have a spiral shape. Therefore, the arc electrode preferably has the above vane or blade-like shape divided by the slit grooves. They are formed in the arc electrode or in both the arc electrode and the electrode support. The slit grooves may be straight.

The plurality of slit grooves of the invention described above, each of which extends from the center of the electrode towards the outer periphery and reaches the side of the electrode from the outer-edge side thereof, provide a plurality of arc travel surfaces which are formed between pairs of the slit grooves, and connection sections which each straddle the slit grooves between slit groove outer peripheries and the electrode outer edges to interconnect the individual arc travel surfaces, and which also have the same resistance value as the arc travel surfaces, wherein the path of current flowing in one arc travel surface is set longer than that of another arc travel surface. It is preferable that the cross-sectional areas of the connection sections are adjusted to control the current flowing from adjacent arc travel surfaces into each connection section therebetween.

The invention is further directed to a vacuum circuit-breaker having a vacuum valve with fixed and movable electrodes in a vacuum container, conductive terminals connecting the respective fixed and movable electrodes in the vacuum valve to the outside thereof, and switching means for driving the movable electrode. The fixed and movable electrodes each comprise arc electrodes, each of which is made of an alloy containing refractory metal particles and a highly conductive metal, and electrode supports which support the respective arc electrodes and are made of a highly conductive metal.

The arc electrode and one of the electrode rod and the electrode support are formed into one unit by sintering or by solid-phase diffusion bonding. The insulating container is circular, and the product y of a rated voltage (kV) and an effective breaking current value (kA) lies within the range from a value given by the following equation (1) to a value given by the following equation (2) based on the outer diameter x (mm) of the insulating container:

$$y=11.25\,x-525 \quad (1)$$

$$y=5.35\,x-242 \quad (2).$$

The invention further features that the diameter y (mm) of the arc electrode lies within the range from a value given by the following equation (3) to a value given by the following equation (4) based on the product x ($kVA\times10^3$) of the rated voltage (kV) and the effective breaking current value (kA):

$$y=0.15\,x+22 \quad (3)$$

$$y=0.077\,x+20 \quad (4).$$

The invention further features that the vacuum container is circular and the diameter y (mm) thereof lies within the range from a value given by the following equation (5) to a value given by the following equation (6) based on the diameter x (mm) of the arc electrode:

$$y=1.26\,x+10 \quad (5)$$

$$y=1.26\,x+30 \quad (6).$$

A set of three vacuum valves is used with respect to three phases, and it is preferable that the three vacuum valves are arranged laterally and assembled into a single unit through plastic insulation tubes.

The invention is further directed to a vacuum valve having fixed and movable electrodes in a vacuum container which is maintained at a high vacuum. The fixed and movable electrodes each comprise arc electrodes, which are made of an alloy containing refractory metal particles, a highly conductive metal and preferably a low-melting-point metal; electrode supports of a highly conductive metal which support the respective arc electrodes; and electrode rods of highly conductive metal, each having rear conductors smaller in diameter than the arc supports and external connection conductors larger in diameter than the rear conductors. Each electrode support and the associated electrode rod are formed into one unit by sintering or by solid-phase diffusion bonding.

The vacuum-valve electrodes according to the invention are of the same structure as described above.

Although pure Cu is preferable as the material for the arc electrode supports, the strength of the material is low, and therefore, it is preferable that a steel-system material such as pure Fe or stainless steel is used to reinforce the supports to prevent deformation of the electrodes.

Furthermore, it is preferable that a double-strata construction be implemented for the arc electrode and the subsequent elements of the electrode support, etc. The electrode support and the subsequent elements are for reinforcing and supporting the arc electrode, and their thickness is preferably half or more of the thickness of the arc electrode, although it is particularly favorable that the thickness of the former is equal to or more than the thickness of the arc electrode. With regard to the refractory metal, in particular, 0.1% to 10% by weight, or preferably 0.5% to 2% by weight, of one or more of Nb, V, Fe, Ti, and Zr can be added as means for increasing the refractory metal content.

It is preferable that the arc electrode be formed from a Cu alloy which contains in particular 30% to 60% by weight Cr and 0.5% to 5.0% by weight, preferably 0.5% to 3.0% by weight, Nb or alternatively from a Cu alloy containing 0.1% to 0.5% Pb by weight which contains in particular 30% to 60% by weight Cr and 0.5% to 5.0% by weight, preferably 0.5% to 3.0% by weight, Nb.

As described above, because the arc electrode and the subsequent elements of the electrode support, etc. are not mechanically joined but are of a metallurgically continuous, integrated construction, and because the elements are in a high-strength combination, it is possible to provide a vacuum circuit-breaker which is highly reliable and safety without any bad influence as compared with conventional vacuum circuit-breakers.

As described above, it is preferable that the arc electrodes are formed in the blade or vane-shape with the curved slit grooves, which are for moving the arcs generated. The slit grooves can be realized in a quick and simple manner by pressure forming a charge of the material powder of the electrical contact in a die which is capable of forming the vane-type structure. Then, by sintering the vane-shaped compact obtained through the pressure formation at a temperature lower than the melting point of the high-conductivity-metal constituent contained therein, an element can be manufactured with the vane shape having the slit grooves. If the outside ends of the slit grooves are uncut and in the state of being joined, the strength of the electrical contact can be increased. Moreover, in order to prevent distortion due to sinter shrinkage, the outer ends of the slit grooves may be kept in the joined condition during the formation and sintering and be cut by outer edge machining after sintering.

The electric contact may have a layer or stratum of only a highly conductive metal on the electrode-rod side. With this construction, the electrical resistance of the electric contact can be lowered, and associated material costs can be reduced. Additionally, a further stratum may be provided on the electrode-rod side, which is made of an alloy powder containing Cu as the main constituent and one or more of Ni, Ti, Zn, Cr, Cd, and Be. With this additional stratum, the strength of the electrical contact is improved, and damage to the electric contact due to impact during electrode opening and closing can be prevented.

It is desirable that the arc electrode and the arc electrode support and the electrode rod be metallurgically joined into one unit during the sintering process. More specifically, the electrode rod, the arc electrode, and the support therefor, which have been formed in desired shapes, are placed and held with the mating surfaces thereof in the correct orientation, and they are sintered in a vacuum or a reducing atmosphere to be diffusion-bonded. In addition, when the arc electrode support is formed with the recess, the protrusion on the electrode rod is fitted in the recess, and they are joined through shrink-fitting of the protrusion due to sinter shrinkage of the electrical contact, a more rigid joining condition can be achieved.

The reinforcing plate of stainless steel, etc. may be disposed between the arc electrode support and the electrode rod when necessary. Specifically, the reinforcing plate is formed with a hole of the same size as the recess provided in the electrical contact, and the protrusion on the electrode rod is passed through the hole in the reinforcing plate and inserted into the recess in the electrical contact. Upon sintering, the reinforcing plate can be secured in position. Alternatively, if the reinforcing plate has the same main constituent material as that of the electrical contact, diffusion bonding may be employed.

As described above, according to the invention, it is possible to combine the electrical contact and the electrode rod into a single integrated unit through the sintering process without using brazing flux. Further, unlike the one-piece infiltration method, no solid solution or diffusion of electrical contact constituents to the electrode-rod side occurs, and electrical contacts of desired dimensions can be achieved with reliability.

Vacuum circuit-breakers are used along with disconnecting switches, grounding switches, lightning arresters, and current transformers, and are employed in high voltage incoming transfer systems which are indispensable for the supply of power in high-rise buildings, hotels, intelligent buildings, underground shopping centers, oil complexes, all types of manufacturing facilities, railway stations, hospitals, assembly halls, electric trains, substations, and public facilities such as water and sewer service installations, etc.

DESCRIPTION OF THE PREFERRED EMBODIMENTS

First Embodiment

Figure 1A:
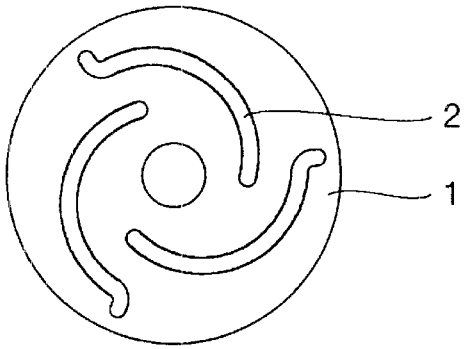
FIGS. 1*a* to 1*d* are plan and side views showing the components of an electrode according to the first embodiment of the invention.
Figure 1B:
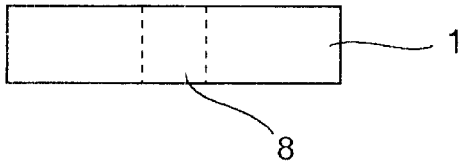
Figure 1C:
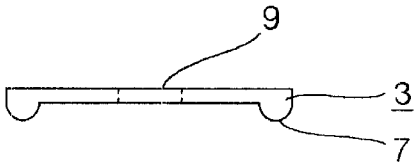
Figure 1D:
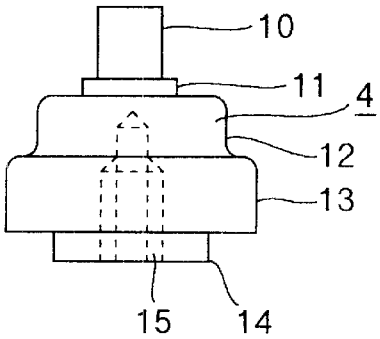

FIG. 1 shows the components of an electrode according to the invention. FIG. 1*a* is a plan view of an arc electrode, and FIG. 1*b* is a side view of the arc electrode. In the figures, 1 denotes a Cu—25%-by-weight Cr compact, which forms the arc electrode after sintering, and 2 denotes a slit groove in the compact. FIG. 1*c* shows a reinforcing plate 3 of austenitic stainless steel, FIG. 1*d* shows a Cu electrode rod 4. A ring-shaped projection 7 for reinforcement is provided on the outside of the stainless steel reinforcing plate 3 opposite to where the arc electrode is to be secured, and a hole 9 is formed for the purpose of joining. The electrode rod 4 has a support portion 10 for joining of the compact 1 which forms the arc electrode, a rear conductor 11 which also acts as a stopper upon insertion, a strength reinforcing section 12 which supplements the strength of the electrode rod, and a reinforcing section 13 which is of a larger diameter than the strength reinforcing section 12. 15 denotes a thread for connection with an external conductor.

The above elements were manufactured as follows. The compact 1 was formed by charging a die, which was capable of forming a blade or vane-type structure having the slit grooves 2, with a mixture of Cu powder and Cr powder pre-mixed at a 75:25 weight ratio and by applying a pressure of 1.5 ton/cm$^2$ to the powder charge by means of a hydraulic press. Regarding the material used, the particle diameter of the Cu powder was 104 $\mu$m or less, and the particle diameter of the Cr powder was in the range of 61 $\mu$m to 104 $\mu$m. The powder mixture charged into the die was of the amount required to have the desired thickness after sintering. The relative density of the compact was 68%.

Figure 2:
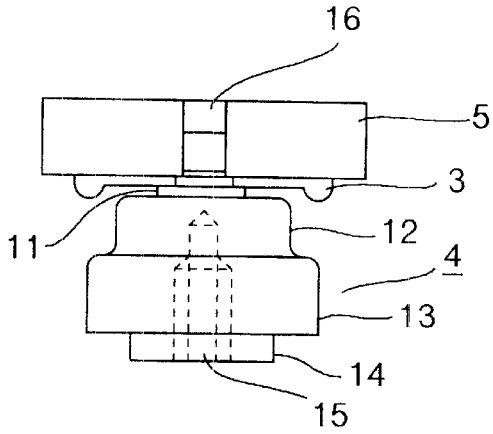
FIG. 2 is a side view of the electrode realized according to the first embodiment.

The austenitic stainless steel reinforcing plate 3 and the electrode rod 4 were formed in advance by machining, and the electrode rod 4 was a plastic-worked member of oxygen-free copper. After acid washing, the projection of the electrode rod 4 was inserted into a recess in the compact 1 and through a hole of the reinforcing plate 3, and these elements were held in this state. This sub-assembly was placed in a vacuum of no more than $6.7\times10^{-3}$ Pa and heated to 1050° C. for 120 minutes. The compact 1 was sintered to provide the arc electrode 5, the projection of the electrode rod 4 was secured in place, and the arc electrode 5, the reinforcing plate 3 and the electrode rod 4 were solid-phase diffusion bonded to form one unit as shown in FIG. 2. Subsequently, the outer periphery of the arc electrode 5 was shaved by machining and the ends of the slit grooves 2 were cut to open the grooves. Because of the sintered element, the arc electrode 5 has a large number of air holes. These holes, if a machining oil were to be used, would be filled with the oil, and it would be difficult to remove the oil. Accordingly, the arc electrode was machined without using a machining oil to form the vane-type shape as shown in FIG. 3.

Figure 3A:
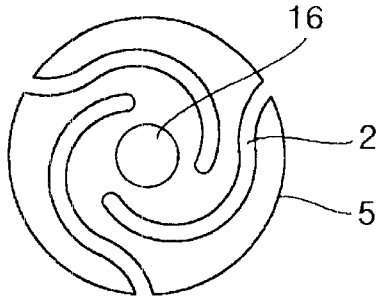
FIGS. 3*a* and 3*b* are plan and side views showing the electrode realized according to the first embodiment.
Figure 3B:
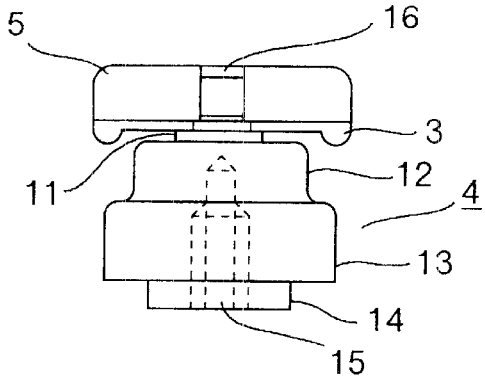
Figure 4A:
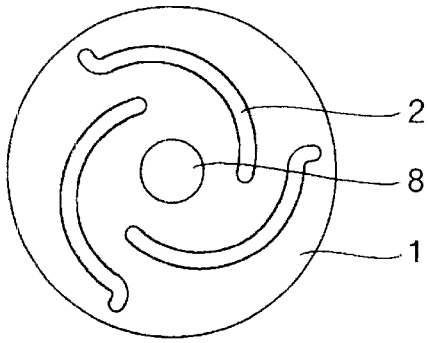
FIGS. 4*a* to 4*d* are plan and side views showing the components of an electrode according to the second embodiment of the invention.
Figure 4B:
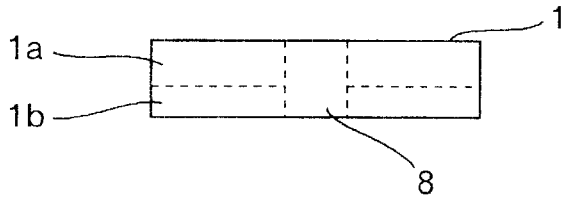
Figure 4C:
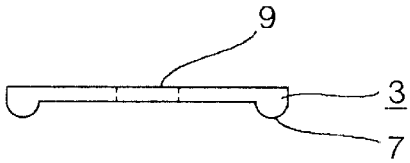
Figure 4D:
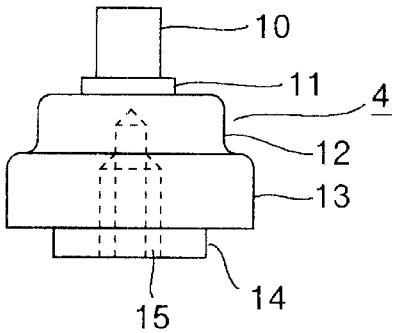

FIG. 3*a* is a plan view of the arc electrode, and FIG. 3*b* is a side view of the whole arrangement. 16 denotes the recess formed in the arc electrode 5 and serves as a button for facilitating driving of arcs, which will be described later.

When scrutinizing the structure of the arc electrode 5 obtained as detailed above, all the material particles were bonded to one another by sintering, and the relative density was 76%. In addition, observing the bonding interface between the arc electrode 5 and the electrode rod 4, it was verified that there were no faults such as openings, and these were metallographically bonded.

Thus, the invention makes it possible to form the grooves in the arc electrode during the formation process. The arc electrode structure can be firmly bonded through sintering, and simultaneously, the electrode rod can be bonded to form an integrated unit.

Second Embodiment

FIG. 4 shows the components of an electrode according to the invention. FIG. 4*a* is a plan view of an arc electrode, and FIG. 4*b* is a side view of the arc electrode. In the figures, 1*a* denotes a Cu—25%-by-weight Cr stratum of a compact 1, which forms the arc electrode, and 1*b* denotes a Cu stratum which forms an arc electrode support.

The manufacturing method will be described. The compact 1, having a Cu—25% Cr stratum and a Cu stratum integrally formed, was made by charging a die, which was capable of forming a vane-type structure having slit grooves 2, with a mixture of Cu powder and Cr powder pre-mixed at a 75:25 weight ratio, by substantially leveling the powder charge, by then adding a subsequent charge of Cu powder, and by applying a pressure of 1.5 ton/cm$^2$ to the powder charge using a hydraulic press. Regarding the material, the particle diameter of the Cu powder was 104 $\mu$m or less, and the particle diameter of the Cr powder was in the range of 61 $\mu$m to 104 $\mu$m. The Cu—25% Cr powder mixture and the Cu powder charged to the die were of the amounts required to have the desired thickness after sintering. The relative density of the compact was 69%.

Figure 5:
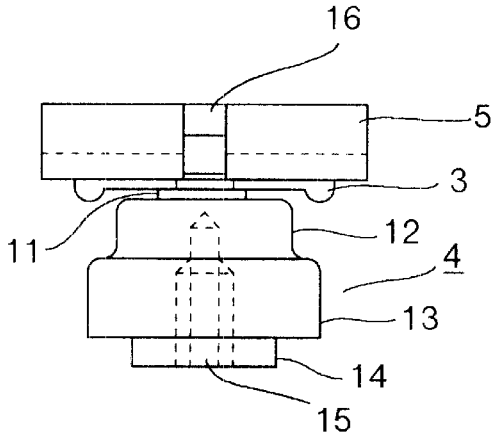
FIG. 5 is a side view of the electrode realized according to the second embodiment.
Figure 6A:
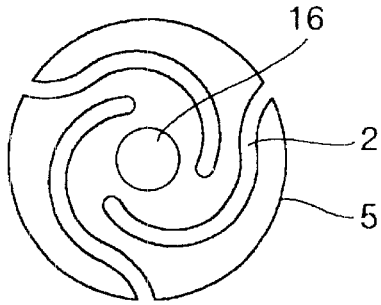
FIGS. 6*a* and 6*b* are plan and side views showing the electrode realized according to the second embodiment.
Figure 6B:
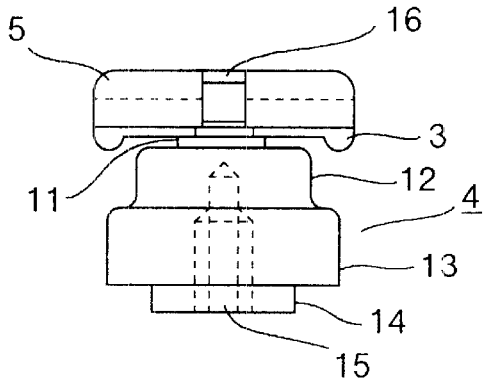

With the Cu—25% Cr stratum of the compact 1 oriented such that it would provide the electrode contact surface, the arc electrode, the arc electrode support and the electrode rod were bonded simultaneously with the sintering in the same manner as in the first embodiment to form a single integrated unit as shown in FIG. 5. Subsequent machining of the compact provided a vane-shaped electrode for use in a vacuum valve as shown in FIG. 6. Reference numerals and characters in the figures are identical to those for the first embodiment.

When the structure of the arc electrode 5 obtained as detailed above was scrutinized, all the constituent particles were bonded to one another by sintering, the interface between the Cu—25% Cr stratum and the Cu stratum was made integrally, and the relative density was 77%. Furthermore, the arc electrode 5 and the electrode rod 4 were solid-phase diffusion bonded as in the first embodiment. Upon observation of the bonding interface between the arc electrode 5 and the electrode rod 4, it was verified that no faults such as openings were present and both the elements were bonded in a metallographic manner.

Thus, according to the invention, it is possible to form the grooves in the arc electrode during the formation process even when the arc electrode has two distinct strata. The arc electrode structure can be firmly bonded through sintering, the interface between the two distinct strata can be made integrally, and simultaneously, the electrode rod can be bonded to form an integrated unit.

Third Embodiment

Figure 7:
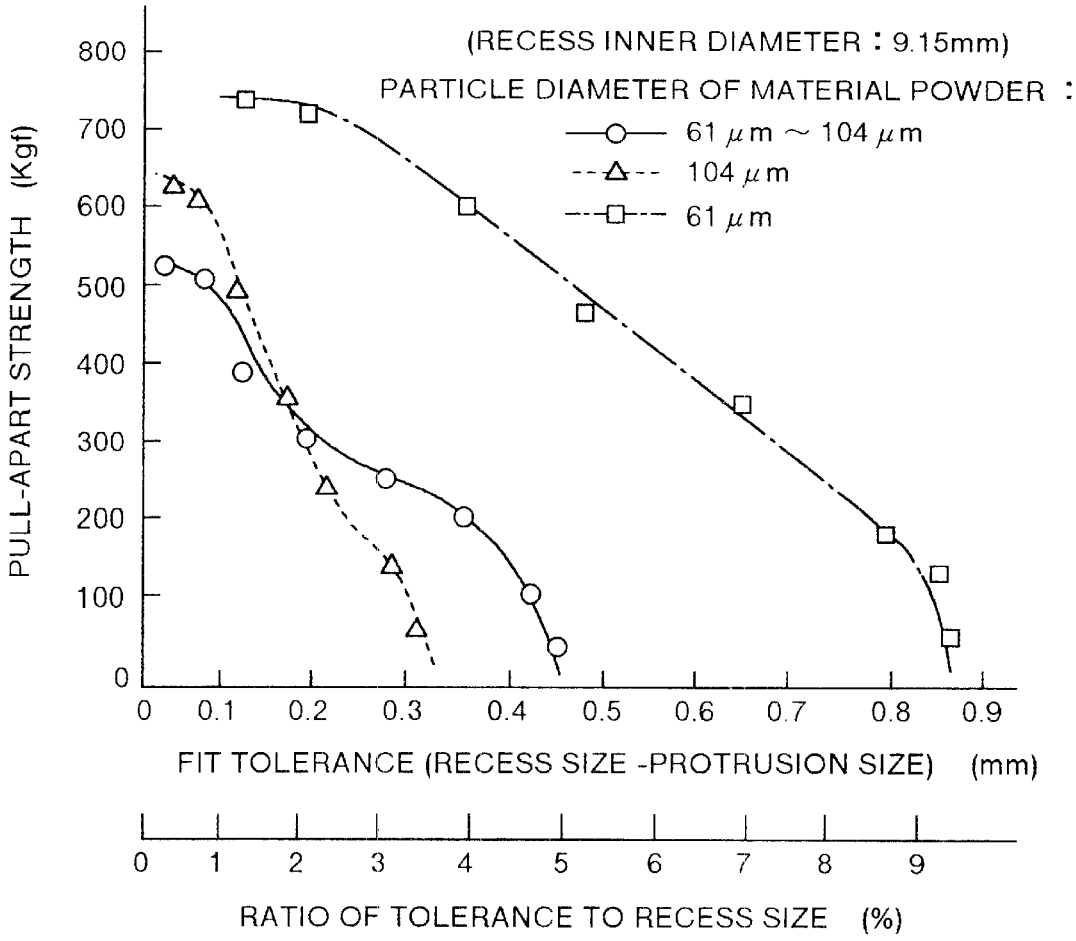
FIG. 7 is a graph showing the relationship between the fitting tolerance of a compact and an electrode rod to the pull-apart force.

FIG. 7 shows a sample of results of measuring pull-apart forces of the arc electrode and the electrode rod while varying the fitting tolerance of the recess in the compact and the protrusion on the electrode rod in the electrode obtained according to the first embodiment. In this embodiment, three different variations of material powder were used, the outer diameter of the compact was set to 49 mm, the inner diameter of the central hole therein was 9.15 mm, and the fitting tolerance was varied by changing the diameter of the protrusion on the electrode rod.

Although the pull-apart force or strength between the arc electrode and the electrode rod becomes larger as the fitting tolerance becomes smaller, an excessively small tolerance will deteriorate the efficiency of the fitting operation and will cause an obstacle to sinter shrinkage, thereby making it impossible to provide a good arc electrode. Further, an excessively large tolerance will lead to an insufficient pull-apart strength, and the arc electrode will detach at the joint when the electrodes fuse together. For this reason, a pull-apart strength of 200 kgf or more is desirable.

Not only the particle diameter of the material powder but also the distribution of particles or the size of the fitting portions varies the optimum fitting tolerance. It is favorable for the tolerance to have a value of 0.5% to 9% of the size of the recess in the compact as shown in FIG. 7. More specifically, a tolerance in the range of 0.5% to 4% of the recess size is desirable when the particle diameter of the material powder is between 61 $\mu$m and 104 $\mu$m, and a tolerance in the range of 1.5% to 9% is desirable when the particle diameter is 60 $\mu$m or smaller.

Thus, setting the fitting tolerance according to the invention enables integration of the arc electrode and the electrode rod with a good joint of proper strength.

Fourth Embodiment

Figure 8:
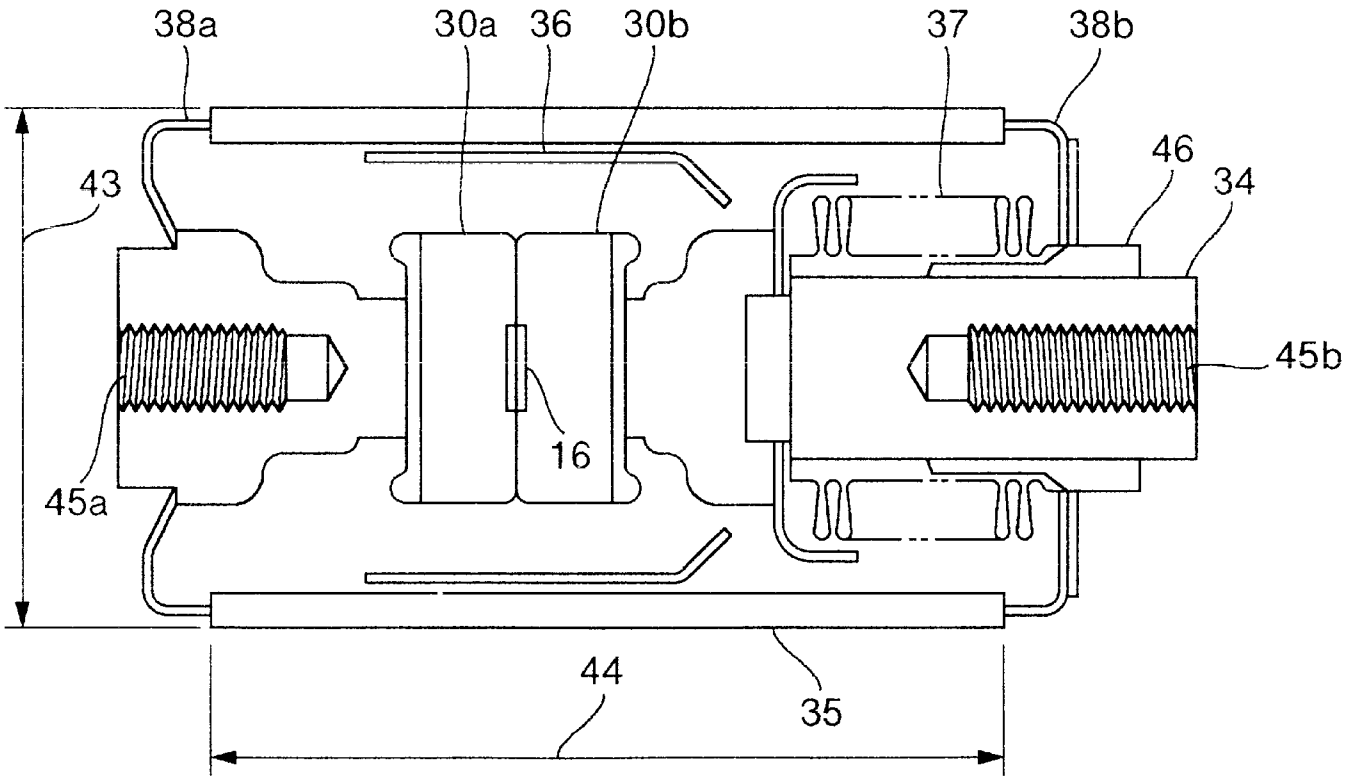
FIG. 8 is a section view of a vacuum valve according to the fourth embodiment of the invention.

FIG. 8 is a section view of the vacuum valve in which the vacuum-valve electrodes realized according to the first and second embodiments are incorporated. An insulation tube 35 is provided at its upper and lower openings with upper and lower seal rings 38*a*, 38*b*, forming a unitary body, to provide the vacuum container of an insulation material for defining a vacuum chamber. A fixed electrode 30*a* is vertically mounted at the middle of the seal ring 38*a*. An electrode rod 34 on the movable side, which constitutes part of a movable side electrode 30*b*, is provided for vertical movement at the middle of the seal ring 38*b* which is positioned immediately below the fixed electrode 30*a*. The arc electrode of the movable electrode 30*b* is mounted for connection to and disconnection from the arc electrode of the fixed electrode 30*a*. Metallic bellows 37 are covered and installed for expansion and contraction at the inside of the seal ring 38*b* which is positioned around the movable electrode 34. A cylindrical seal member 36, formed of a metal plate, is mounted on the vacuum container of the insulation tube 35 around the pair of arc electrodes. The seal member 36 is so designed as not to deteriorate the insulation of the vacuum container of the insulation tube 35. The fixed electrode 30*a* is provided with a threaded hole 45*a*, whereas the movable electrode 30*b* is brazed to the electrode rod 34 which provides connection to the outside. It is also possible to make the connection using a thread in the same manner as the fixed electrode.

Glass or ceramic sintered materials are used for the insulation tube 35. The vacuum container is brazed to the seal rings 38*a*, 38*b* using an alloy plate of Kovar or the like which has a thermal expansion coefficient close to that of glass or ceramic, and the container is kept at a large vacuum of $10^{-6}$ mmHg or more.

The external conductor connection section on either electrode is provided with the thread 45*a* or 45*b* and connected to an external terminal to provide a path for electric current. An exhaust pipe (not shown) is provided on the seal ring 38*a* and is connected to a vacuum pump when the container is to be evacuated. A getter is provided for absorbing a minute amount of gas when generated in the vacuum container to maintain the vacuum. The seal member 36 has a function of letting metallic material evaporating from the surfaces of the main electrodes adhere thereto, which metallic material is generated due to arc, and of cooling the same. The adhered metal has the effect of a getter and serves for maintaining the vacuum level.

In the drawings, 43 denotes the outer diameter of the insulation tube, 44 its length, and 16 a button which is formed by the circular recess of a desired depth.

Fifth Embodiment

Figure 9A:
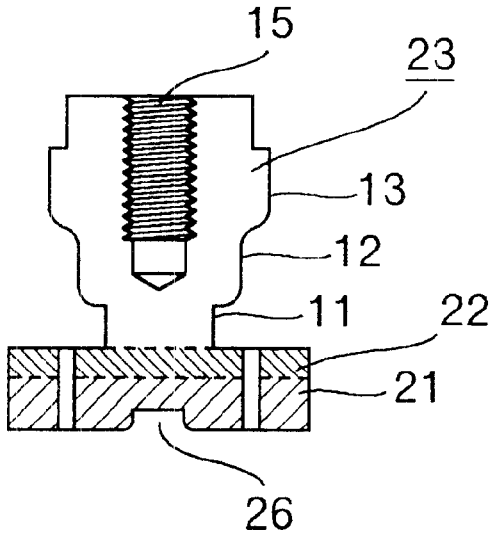
FIGS. 9*a* and 9*b* are section views of a vacuum-valve electrode according to the fifth embodiment of the invention.
Figure 9B:
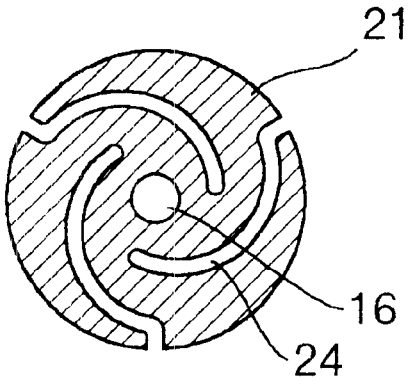

FIG. 9 shows sections of an electrode prototype which was fabricated in accordance with the method of the invention. FIG. 9*a* is a sectional view of the electrode, and FIG. 9*b* is a plan view thereof. In the figures, 21 denotes a Cu—25% Cr stratum which constitutes an arc electrode of the electrical contact, 22 a Cu—40% Ni alloy stratum which constitutes an arc electrode support, 23 a Cu electrode rod which serves also as a connection for an external conductor, and 24 a slit groove.

The above elements were made as follows. Used was a die capable of making slit grooves 24 completely through the arc electrode 21 and the electrode support 22 to form them in a vane shape. The die was charged with a powder mixture of Cu and Cr mixed at a 75:25 weight ratio, and the contents of the die were made substantially even by a brush. In addition, Cu—40% Ni alloy powder was added to the die and was leveled. The respective powders were of amounts required to have a desired size after sintering. Formation was performed by applying a pressure of 3 ton/cm$^2$ to the charged powders using a hydraulic press to thereby provide a vane-shaped compact with the slit grooves 24. The relative density of the compact was 79%.

Then, the Cu electrode rod 23, which serves as the connection for an external conductor and which had been machined to the desired shape in advance, was placed and held on the Cu—Ni stratum surface of the compact obtained as described above. The assembly was kept at 1050° C. and in a vacuum of no more than $6.7\times10^{-3}$ Pa for 120 minutes, so that the arc electrode 21 and the electrode support 22 were sintered and the electrode rod 23 was diffusion-bonded to them.

When the structure of the electrical contact thus formed was scrutinized, the material particles were bonded by sintering, and the relative density was 87%. Furthermore, upon observing the bonding interface between the electrode support 22 and the electrode rod 23, it was verified that the crystals contained within both the elements were bonded metallographically. The arc electrode 21 was formed at its center with a circular recess 16. The recess has a function of causing arcs to be generated upon current breaking at the periphery of the electrode and to move to the outer periphery at high speed, thereby enabling breaking of a large current.

Thus, the invention makes it possible to make the grooves in the arc electrode during its formation. The electrical contact structure can be firmly bonded through sintering, and simultaneously, the electrode rod can be bonded to form an integrated unit.

Sixth Embodiment

Figure 10A:
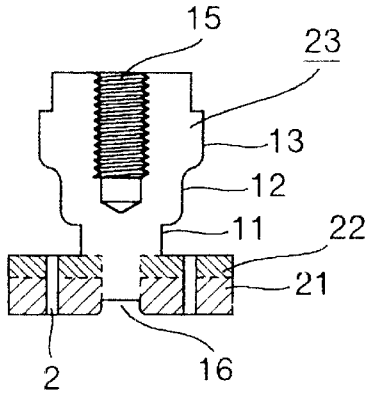
FIGS. 10*a* and 10*b* are section views of a vacuum-valve electrode according to the sixth embodiment of the invention.
Figure 10B:
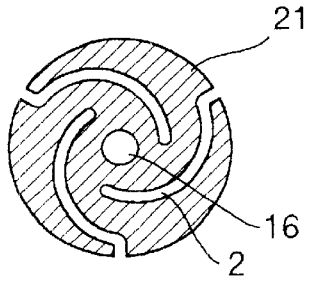

FIG. 10 shows sections of an electrode prototype which was manufactured in accordance with the method of the invention. In the figures, an electrode support 22 is a reinforcing plate of stainless steel, and an arc electrode 21 of an electrical contact and the arc electrode support 22 have shapes at centers of which a circular hole 25 passes through.

The manufacturing method will be described. A die, which was capable of perforating slit grooves 24 and forming a vane-type structure, was charged with a powder mixture of Cu and Cr mixed at a 75:25 weight ratio, and the contents were leveled. The powder charged was of the amount required to achieve the desired size after sintering. Formation was performed by applying a pressure of 3 ton/cm$^2$ to the charged powder using a hydraulic press, thus providing a vane-shaped structure through which the central hole 25 passed and which had the slit grooves 24. The relative density of the compact was 77%. A recess was formed in the surface of the arc electrode 21, similarly to the fifth embodiment.

Then, the arc electrode support 22, which had been machined to the desired shape in advance, was placed and held on the electrode-rod side of the compact obtained, and a protrusion on an electrode rod 23, which serves as a connection for an external conductor, was inserted into the holes in the arc electrode support 22 and the compact. The assembly was kept at 1050° C. in a vacuum of no more than $6.7\times10^{-3}$ Pa for 120 minutes to sinter the arc electrode 21, to diffusion-bond the electrode rod 23, and to secure the arc electrode support 22. The diameter of the protrusion on the electrode rod 23 was set to be larger than the diameter of the hole in the arc electrode 21 after sintering, so that stress of compression in the radial direction would remain in the fitting portions after sintering.

When the structure of the arc electrode 21 formed as detailed above was scrutinized, the respective material particles were bonded by sintering, and the relative density was 84%. Furthermore, upon observation of the bonding interface between the arc electrode 21 and the connection 23 for an external conductor, it was verified that their crystals were bonded metallographically. Further, the arc electrode support 22 was firmly fixed between the arc electrode 21 and the electrode rod 23.

Thus, according to the invention, by fitting the projection of the electrode rod into the recess of the electrical contact and sintering them, a mechanical compression is applied to the joint through sinter shrinkage, thereby achieving a firmly-bonded condition.

Seventh Embodiment

Figure 11:
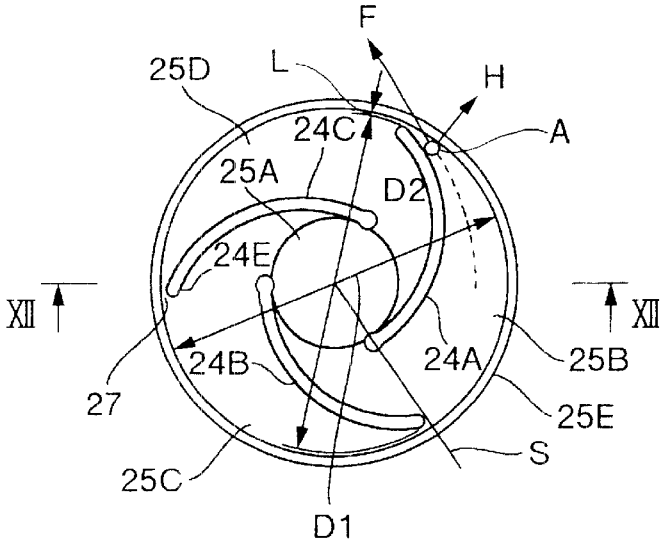
FIG. 11 is a plan view of a vacuum-valve electrode with spiral grooves according to the seventh embodiment of the invention.
Figure 12:
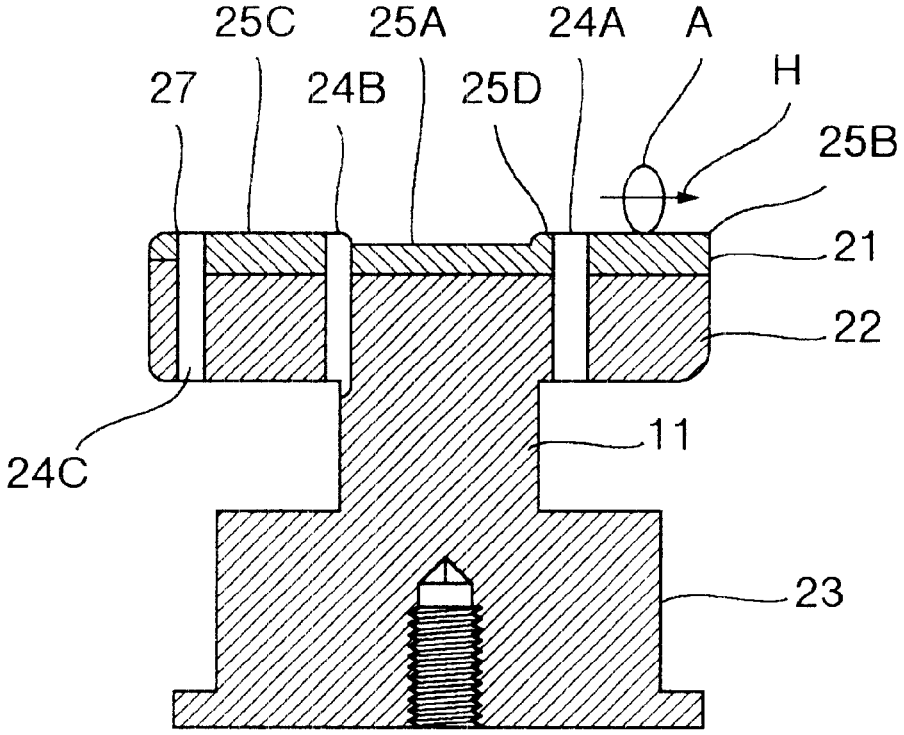
FIG. 12 is a section view of the electrode shown in FIG. 11.

FIG. 11 is a plan view and FIG. 12 is a section view of a spiral-type electrode according to the seventh embodiment of the invention, which has been made in a similar manner to the fifth and sixth embodiments. As shown in these figures, the spiral electrode is further machined to have a circular recess 25A at the center of the electrode and arc travel surfaces 25B, 25C, 25D outside the recess, which serve also as contact surfaces for the opposite electrode. Three slit grooves 24A, 24B, 24C are cut in a spiral shape through the arc electrode 21 and the arc electrode support 22, which each extend between the arc travel surfaces 25B, 25C, 25D from the recess 25A to positions inside the outer peripheral ends of the arc travel surfaces 25B, 25C, 25D. Although the grooves of the spiral shape are three in the embodiment, they may be four or five and be either curved or straight. It is preferable that the diameter of the circular recess 25A is substantially equal to that of the rear conductor 11.

The plurality of slit grooves 24A, 24B, 24C extend from the recess 25A and reach the outer ends 24E. The plurality of arc travel surfaces 25B, 25C, 25D are defined between the slit grooves. Interconnections 27 straddle the slit grooves 24A, 24B, 24C between the outer ends 24E thereof and the outer peripheral ends 25E of the arc travel surfaces, that is, the interconnections serve as bridges. The interconnections are formed integrally with the arc travel surfaces 25B, 25C, 25D, and each have the same resistance value as the arc travel surfaces 25B, 25C, 25D.

Accordingly, when an arc A flows through each arc travel surface and the interconnection 27, the quantity of heat generated is little, and the current capacity of the electrode can be increased. As the interconnections 27 are formed integrally with the arc travel surfaces 25B, 25C, 25D, the surfaces of the interconnections 27 can be of the same level with the arc travel surfaces 25B, 25C, 25D, and the size in the axial direction can be reduced. Further, because of no electrostatic convergence, electrical fields can be relaxed, and the breaking current capacity can be further improved.

Each interconnection 27 is adjusted to control the current so that, when the path of a current $i_1$ flowing through one arc travel surface, for instance the arc travel surface 25B, is formed longer than the path of a split current $i_2$ flowing through another arc travel surface 25D, the current $i_1$ flows from the one arc travel surface 25B to the other arc travel surface 25D. For example, the width L of the interconnection between the outer diameter and the inner diameter is set accordingly. More specifically, the width L is set in such a way that the ratio $D_2/D_1$ of the outer diameter $D_1$ and the inner diameter $D_2$ is larger than 0.9 and is less than 1. This means that the interconnection 27 is set such that the path of a current $i_1$ flowing through one arc travel surface, for example the arc travel surface 25B, is longer than the path of the split current $i_2$ flowing through the other arc travel surface 25D.

The path of the current $i_1$ flowing in the fixed or movable electrode can be controlled to attain an almost circumferential, reciprocating current path. Due to a magnetic field H which is created when the current $i_1$ flows through the path, the arc A generated between the electrodes is driven towards the outer peripheries of the electrodes, moving across the arc travel surfaces.

When, for example, the arc A is moving across the arc travel surface 25B and reaches the boundary to the adjacent arc travel surface 25D, the arc is expected to pass across the interconnection 27 to the arc travel surface 25D. However, flowing through the arc travel surface 25D is a so-called split current $i_2$ which is divided from the current ivia the slit groove 24A. The present inventors have found that the split current $i_2$ acts to prevent the current $i_1$ in the arc travel surface 25B from flowing into the arc travel surface 25D and the arc A stagnates in the vicinity of the interconnection 27. This can lead to local heating and fusion of the electrodes, and to inability to complete the breaking operation.

The present inventors have provided the solution for the above problem of controlling flowing of the current $i_1$ and the split current $i_2$ into the interconnection 27 by adjusting the sectional area, or length and width, of the interconnection 27. More specifically, the width L was set in such a way that the ratio $D_2/D_1$ of the outer diameter $D_1$ and the inner diameter $D_2$ is larger than 0.9 and is less than 1. As a result, the arc A was driven towards the periphery of the electrode, performing magnetic drive on the arc travel surface and allowing remarkable increases in the breaking current capacity. Assuming, for example, the breaking current capacity of a conventional electrode to be of magnitude 1, wherein the width L of the interconnection 27 is not adjusted, a breaking current capacity of magnitude 2 is attainable with the electrode according to the invention. As a result, the electrode of the invention can be made smaller and lighter than that of the conventional art.

The reason for the above is that, if the ratio $D_2/D_1$ is less than 0.9, the width L of the interconnection 27 becomes larger to increase the split current $i_2$ divided from the current $i_1$, and the current $i_1$ stagnates in the vicinity of the interconnection 27 to cause inability of breaking. On the other hand, if the ratio $D_2/D_1$ is 1 or larger, the width L of the interconnection 27 decreases, an excess of the current $i_1$ flows through the interconnection 27, the magnetic field H increases in strength, and the arc A is impelled out of the electrode by the electromagnetic force F and collides with the shield 36, so that the arrangement cannot act as a circuit-breaker. Accordingly, when the width L is set such that the ratio $D_2/D_1$ of the outer diameter $D_1$ and the inner diameter $D_2$ is larger than 0.9 and less than 1, the flow of the current $i_1$ and the split current $i_2$ through the interconnection 27 can be adjusted properly. In this case, it is advantageous to control the split current $i_2$ rather than the current $i_1$, because the width of the interconnection 27 can be made smaller to thereby lighten the electrode. Hence, it is possible to achieve the above effect. This means that it is possible to arbitrarily set electrode size and weight through adjustment of the width L alone in accordance with an increase or decrease of the breaking current capacity. It is preferable to adjust the interconnection 27 through its thickness. The width L of the interconnection 27 is easy to adjust, and the efficiency of working is high, because a worker can make fine adjustments while visually seeing the same.

Eighth Embodiment

Table 1 shows the data of vacuum valves for a range of various ratings. The vacuum-valve electrodes used in the embodiment are obtained in accordance with the composition and construction described in the first to third embodiments and the fifth to seventh embodiments.

Figure 13:
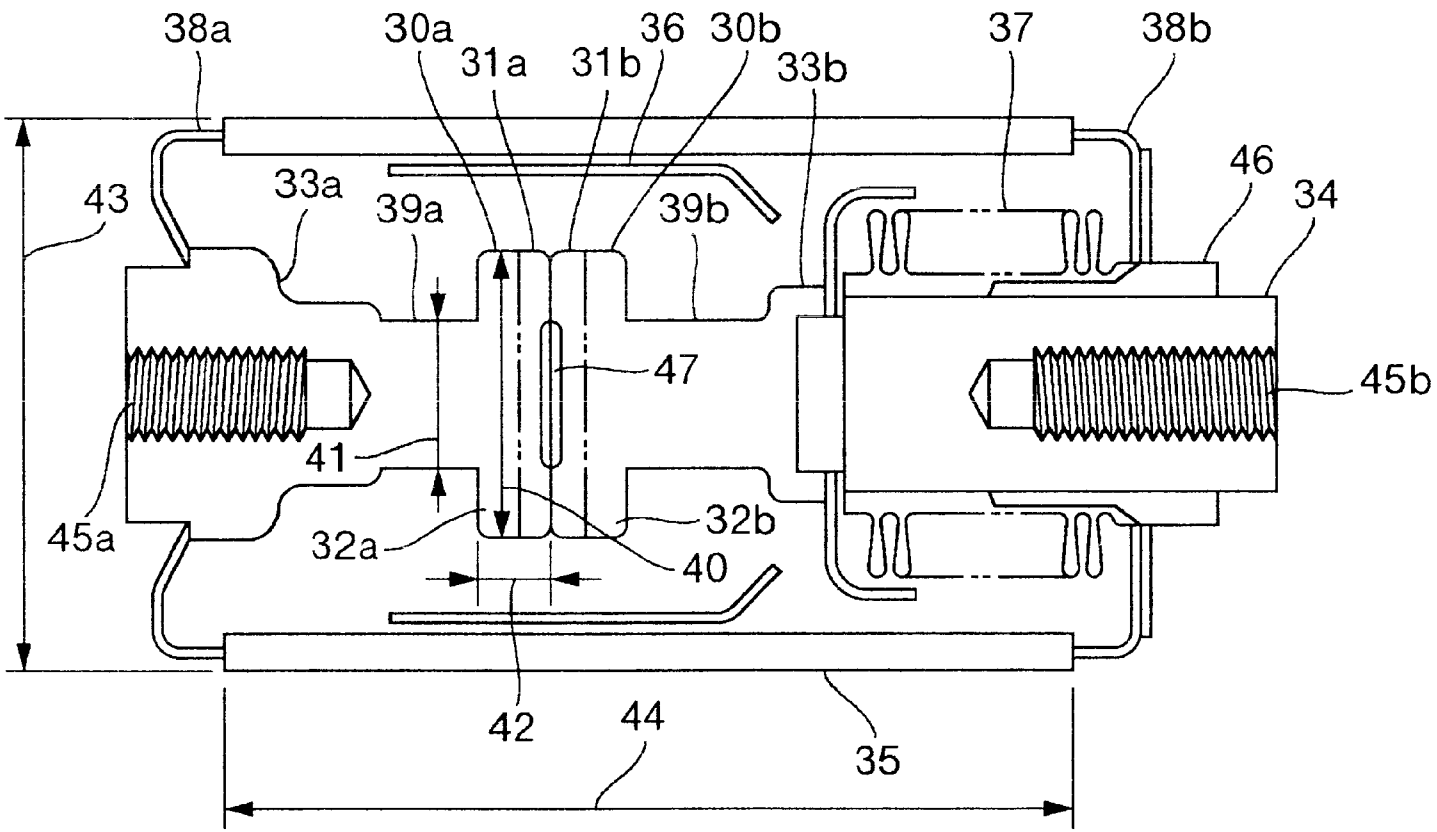
FIG. 13 is a section view of a vacuum valve.
Figure 14:
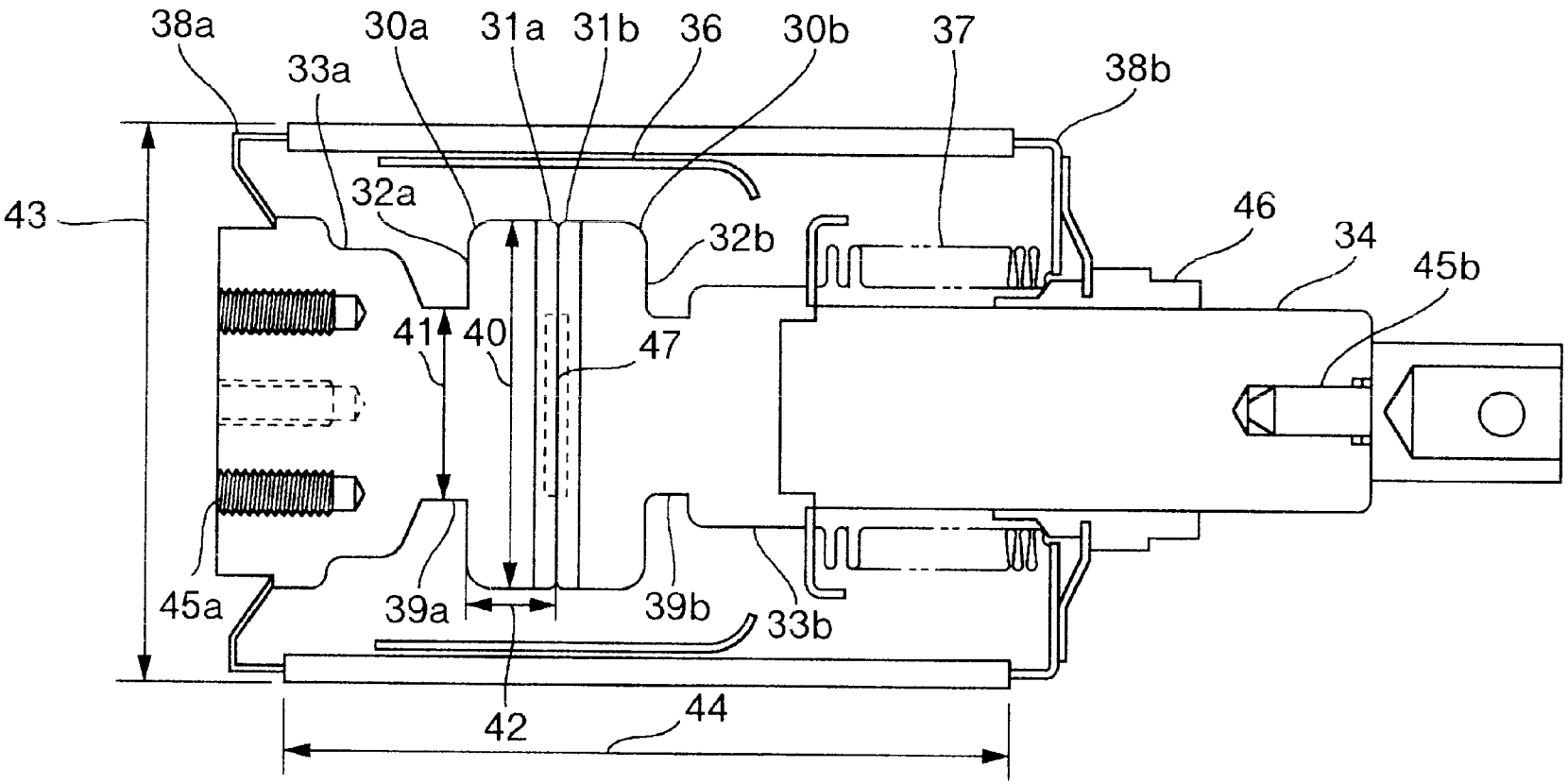
FIG. 14 is a section view of another vacuum valve.

FIG. 13 is a section view of the No. 1 vacuum valve listed in Table 1. Similarly, FIG. 14 is a section view of the No. 4 vacuum valve in Table 1.

TABLE 1

| Item | | No. 1 | 2 | 3 | 4 | 5 | 6 | 7 | 8 | 9 |
|---|---|---|---|---|---|---|---|---|---|---|
| Rating | Current (A) | 600 | 600 | 1200 | 2000 | 3000 | 3000 | 600 | 1200 | 2000 |
| | Voltage (kV) | 7.2 | 7.2 | 7.2 | 7.2 | 7.2 | 15 | 12 | 7.2 | 24 |
| | Effective breaking current value (kV) | 12.5 | 20 | 31.5 | 40 | 63 | 50 | 16 | 31.5 | 25 |
| | Effective breaking voltage current value ($\times 10^3$ kVA) | 90 | 142 | 226.8 | 288 | 453.6 | 750 | 192 | 226.8 | 600 |
| Insulation tube | Outer diameter (mm) | 62 | 72 | 90 | 100 | 130 | 130 | 72 | 90 | 100 |
| | Length (mm) | 100 | 100 | 130 | 130 | 215 | 215 | 130 | 170 | 215 |
| Rear conductor | Electrode rear conductor diameter (mm) | 15 | 16 | 22 | 30 | 38 | 38 | 16 | 22 | 26 |
| Electrode | Diameter (mm) | 32 | 42 | 57 | 66 | 86 | 86 | 39 | 57 | 66 |
| | Thickness (mm) | 8 | 9 | 10 | 15 | 17 | 17 | 9 | 10 | 10 |
| | Recess diameter (mm) | 15 | 16 | 22 | 30 | 38 | 38 | 16 | 22 | 26 |
| | Recess depth (mm) | 1 | 1 | 2 | 2 | 3 | 3 | 1 | 2 | 2 |

TABLE 1-continued

| Item | No. 1 | 2 | 3 | 4 | 5 | 6 | 7 | 8 | 9 |
|---|---|---|---|---|---|---|---|---|---|
| Number of spiral grooves | 3 | 3 | 3 | 4 | 6 | 6 | 3 | 3 | 3 |
| Spiral groove width (mm) | 2 | 2 | 2 | 2.5 | 3 | 3 | 2 | 2 | 2 |

An insulation tube 35 is provided at its upper and lower openings with upper and lower seal rings 38*a,* 38*b,* which forms a unitary body, to provide the vacuum container of an insulation material for defining a vacuum chamber. A fixed electrode 30*a* is vertically mounted at the middle of the seal ring 38*a.* An electrode rod 34 on the movable side, which constitutes part of a movable side electrode 30*b,* is provided for vertical movement at the middle of the seal ring 38*b* which is positioned immediately below the fixed electrode 30*a.* The arc electrode of the movable electrode 30*b* is mounted for connection to and disconnection from the arc electrode of the fixed electrode 30*a.* Metallic bellows 37 are covered and installed for expansion and contraction at the inside of the seal ring 38*b* which is positioned around the movable electrode 34. A cylindrical seal member 36, formed of a metal plate, is mounted on the vacuum container of the insulation tube 35 around the pair of arc electrodes. The seal member 36 is so designed as not to deteriorate the insulation of the vacuum container of the insulation tube 35.

Further, the arc electrodes 31*a,* 31*b* are integrally bonded to respective arc electrode supports 32*a,* 32*b,* which are obtained through the infiltration described hereinbefore, and further comprise external conductor connections 33*a,* 33*b* and rear conductors 39*a,* 39*b,* respectively.

Glass or ceramic sintered materials are used for the vacuum container of the insulation tube 35. The vacuum container is brazed to the seal rings 38*a,* 38*b* using an alloy plate of Kovar or the like which has a thermal expansion coefficient close to that of glass or ceramic, and the container is kept at a large vacuum of $10^{-6}$ mmHg or more.

The external conductor connection section on either electrode is provided with a thread 45*a* or 45*b* and connected to an external terminal to provide a path for electric current. An exhaust pipe (not shown) is provided on the seal ring 38*a* and is connected to a vacuum pump when the container is to be evacuated. A getter is provided for absorbing a minute amount of gas when generated in the vacuum container to maintain the vacuum. The seal member 36 has a function of letting metallic evaporate from the surfaces of the main electrodes adhere thereto, which is generated due to arc, and of cooling the same. The metal adhered has the effect of a getter and serves for maintaining the vacuum level.

With regard to the dimensions indicated in FIGS. 13 and 14, 43 is the outer diameter of the insulation tube, 44 is the length of the same, 41 is the diameter of the rear conductor of the electrode, 40 is the diameter of the electrodes, and 42 is the thickness of the same. 46 denotes a guide, and 47 denotes a button. The button 47 is a circular recess of a desired depth and is similar to the recess 5A shown in FIG. 15.

As listed in Table 1, depending on the difference of rating breaking capacity, the vacuum valve of the invention varies in insulation tube external diameter and length, rear conductor diameter, electrode diameter and thickness, recess diameter and depth, number of spiral grooves, and spiral groove thickness.

Figure 15:
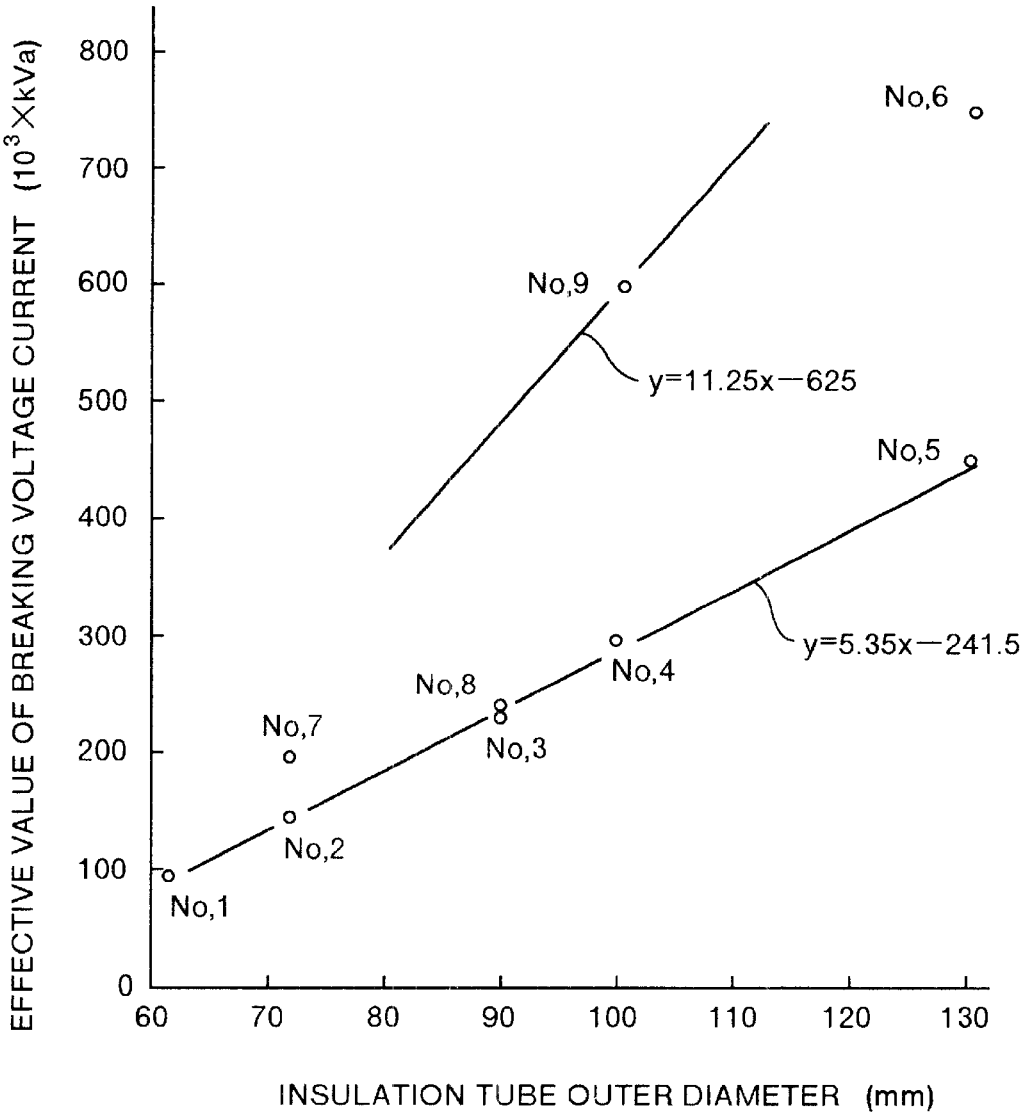
FIG. 15 is a graph showing the relationship between the effective breaking voltage current value and the outer diameter of an insulation tube.

FIG. 15 is a graph showing the relationship between an effective breaking voltage current value (y) and the outer diameter (x) of the insulation tube. The effective breaking voltage current value is the product of a breaking voltage (kV) and an effective breaking current value (kA). As can be seen in the figure, it is preferable to have an insulation tube outer diameter which corresponds to a value of effective breaking voltage current value (y) lying between the values given by y=11.25 x−525 and y=5.35 x−241.5 with respect to the effective breaking voltage current value.

Figure 16:
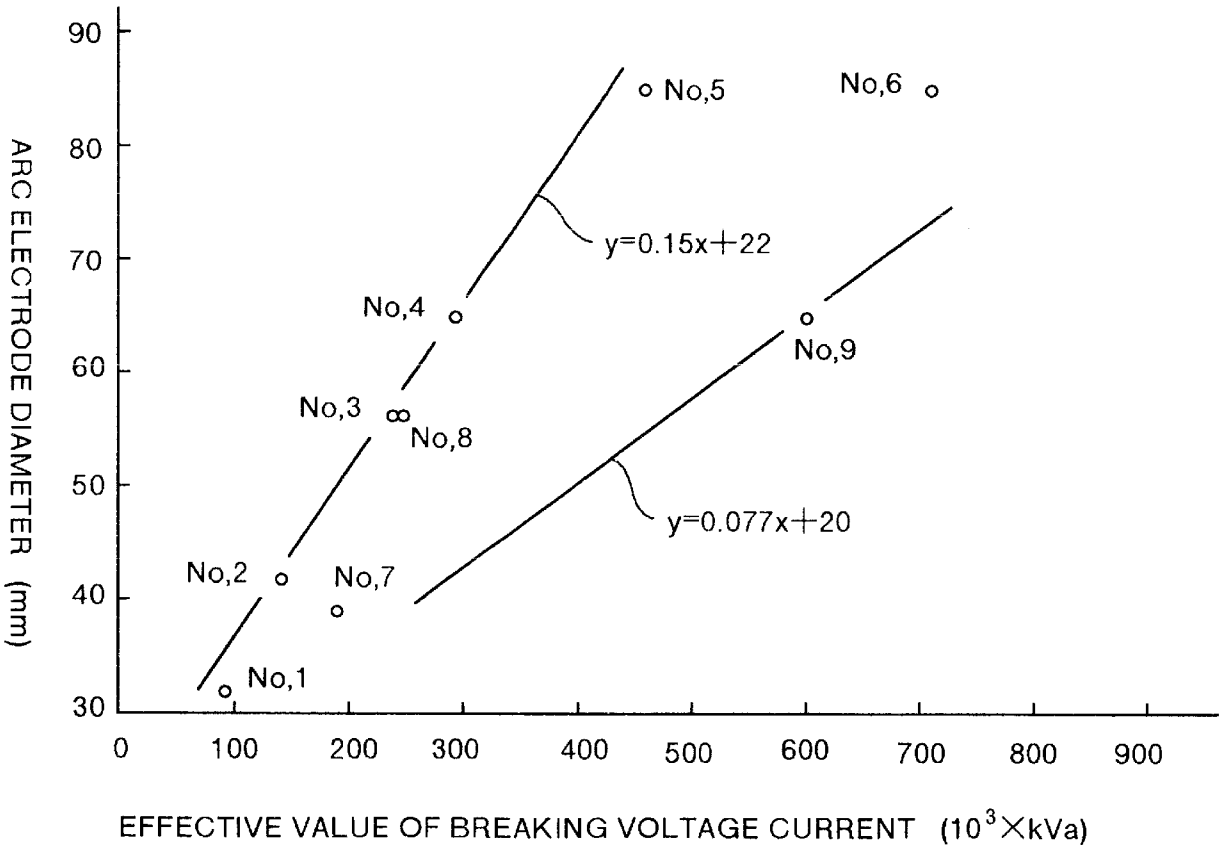
FIG. 16 is a graph showing the relationship between an arc electrode diameter and the effective breaking voltage current value.

FIG. 16 is a graph showing the relationship between an arc electrode diameter (mm) and an effective breaking voltage current value ($x10^3$ kVA). It is desirable to set an arc electrode diameter (y) which lies between the values given by y=0.15 x+22 and y=0.077 x+20 with respect to the effective breaking voltage current value (x).

Figure 17:
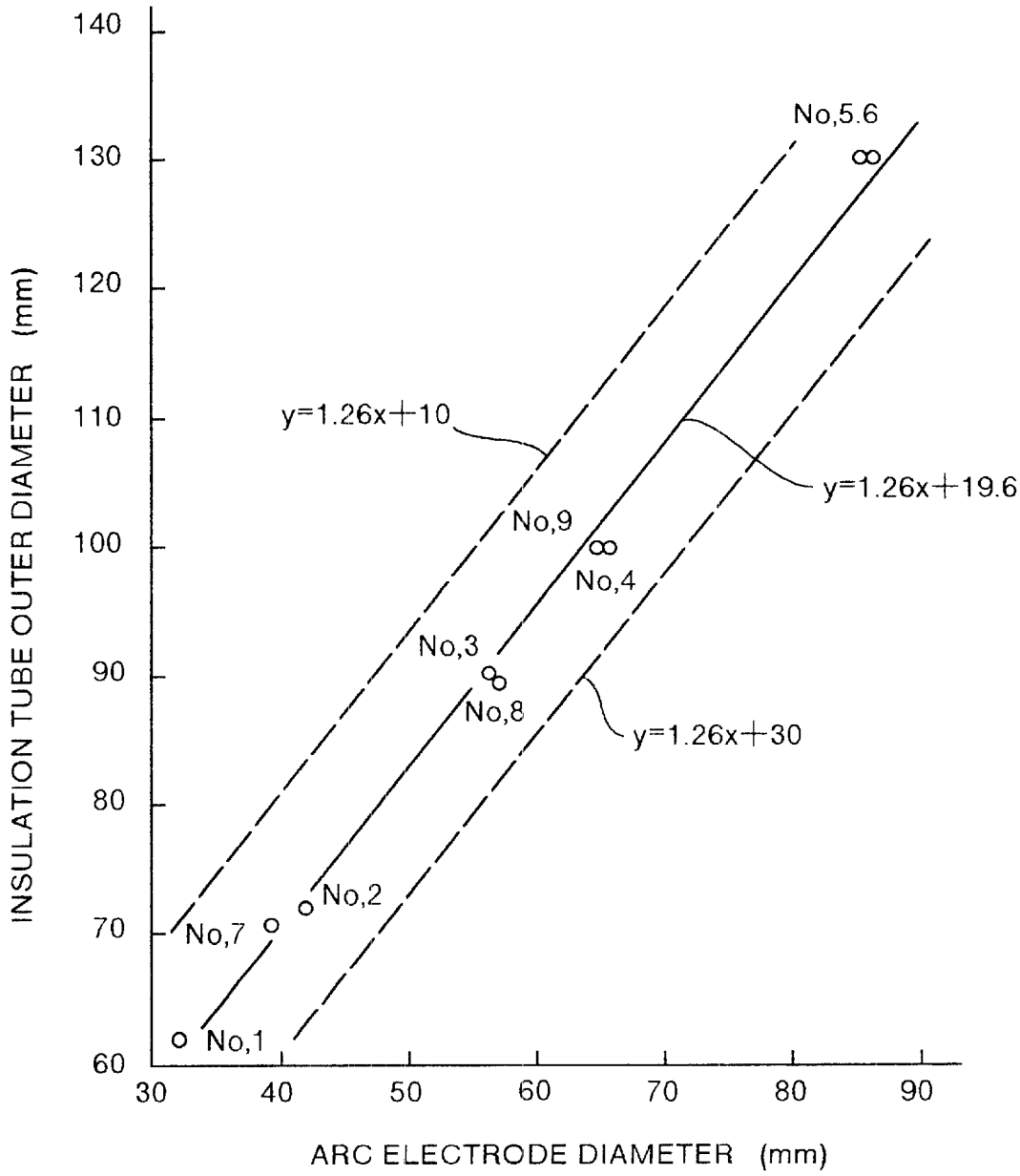
FIG. 17 is a graph showing the relationship between an insulation tube external diameter and an arc electrode diameter.

FIG. 17 is a graph showing the relationship between an insulation tube external diameter (y) and an arc electrode diameter (x). It is desirable to set an insulation tube external diameter (y) which lies between the values given by y=1.26 x+10 and y=1.26 x+30. In this embodiment, the external diameter of the insulation tube is set to the value given by y=1.26 x+19.6.

Figure 18:
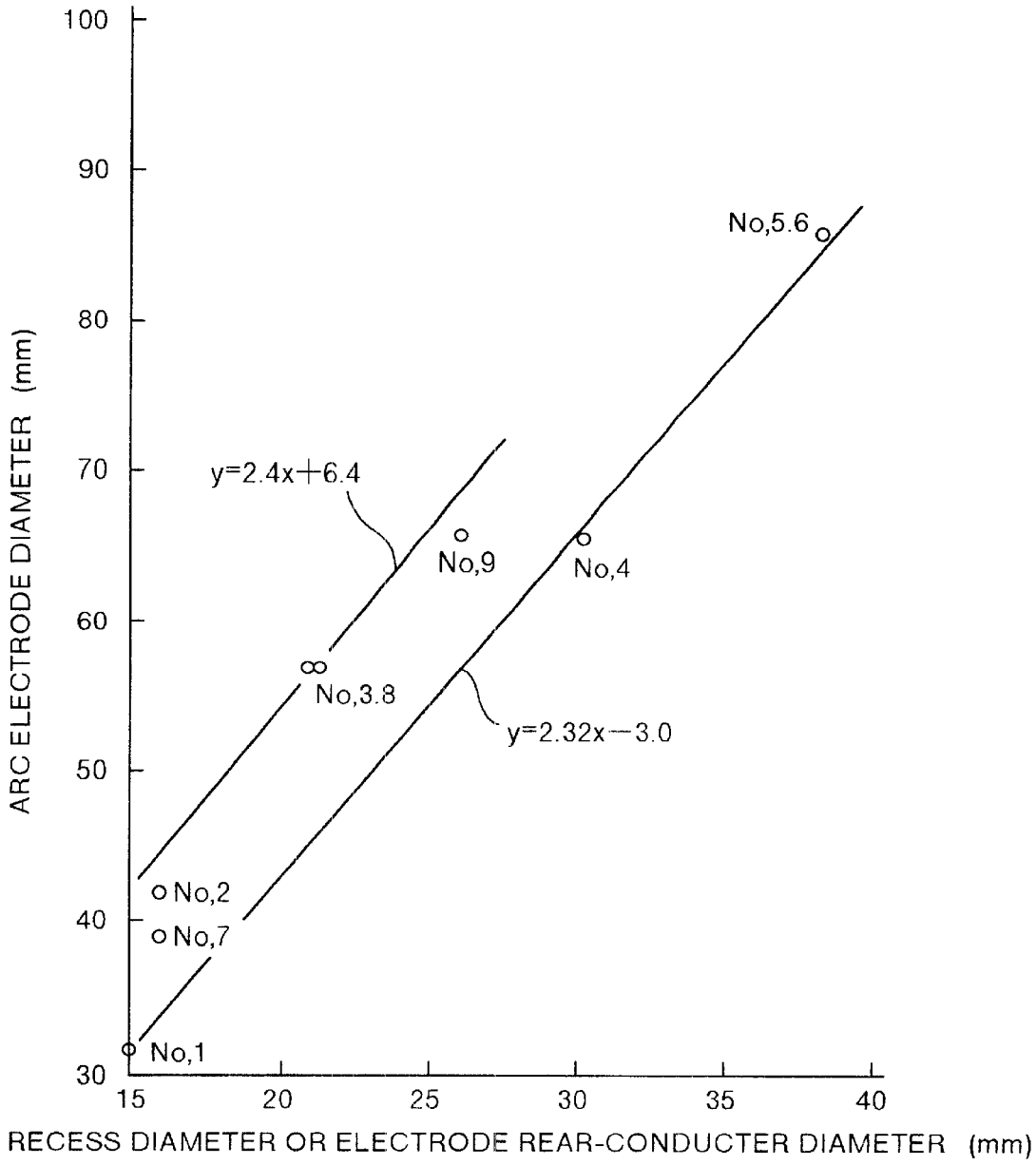
FIG. 18 is a graph showing the relationship between an arc electrode diameter and a recess diameter or electrode rear-conductor diameter.

FIG. 18 is a graph showing the relationship between an arc electrode diameter (y) and a recess diameter (x), or alternatively, an electrode rear-conductor diameter (x). It is desirable to set an arc electrode diameter which lies between the values given by y=2.4 x+6.4 and y=2.32 x−3.0.

Ninth Embodiment

Figure 19:
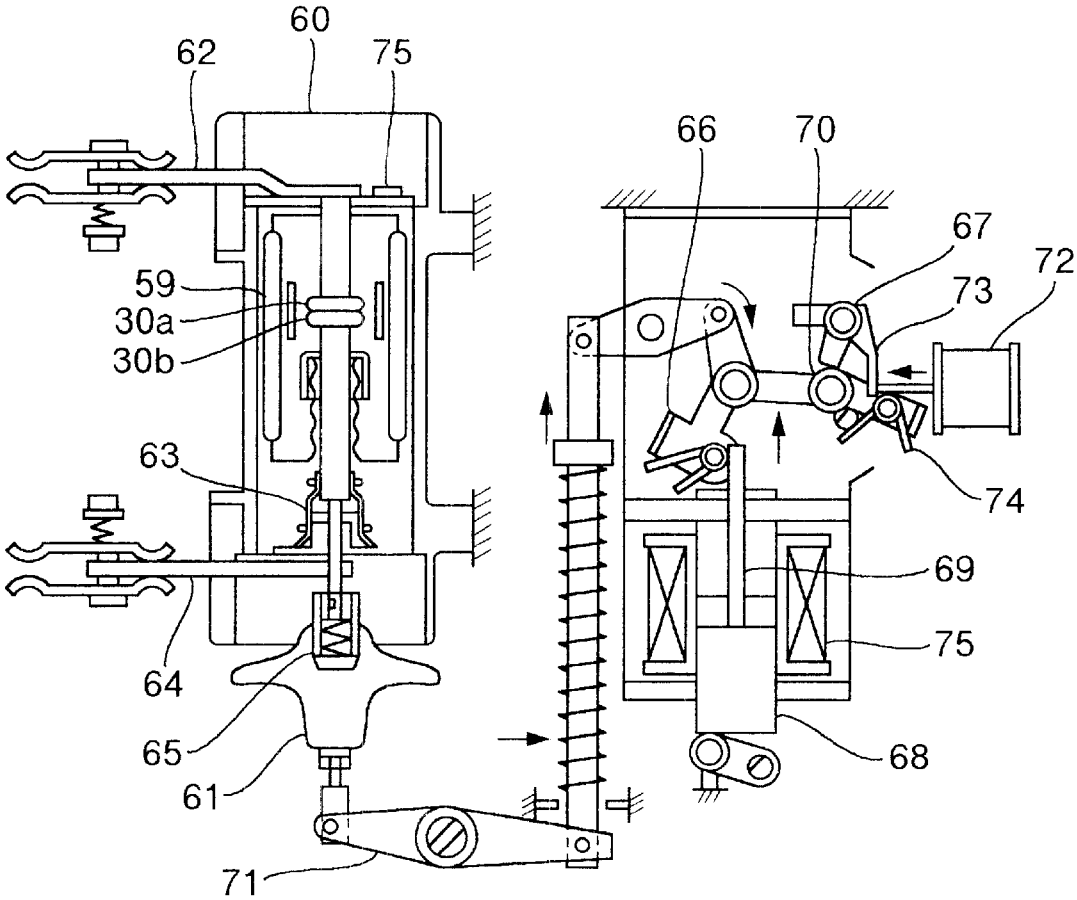
FIG. 19 is a schematic view showing the whole construction of a vacuum circuit-breaker.

FIG. 19 is a view of an arrangement of a vacuum circuit-breaker, showing a vacuum valve 59 as detailed in the fourth and eighth embodiments and the operating device thereof.

The vacuum circuit-breaker is of a small and light construction wherein the operating device is arranged on the front side and three sets of three-phase, batch type epoxy-resin tubes 60 are arranged on the rear side, which have tracking resistance and support the vacuum valves.

Each phase end is held horizontally by the epoxy-resin tube and a vacuum valve support plate and is of a horizontal-draw configuration. Switching of the vacuum valve is performed by the operating device through an insulation operator rod 61.

The operating device is simple, small, and light in construction and is a solenoid-operated, free mechanical pull-apart mechanism. The switching stroke is short and the mass of the movable section is small, thereby resulting in a small impact. Disposed on the front side of the breaker are a manually-connecting type secondary terminal, a switching condition display, an operating cycle indicator, a manual pull-apart button, a manual loader, a drawer, an interlock lever, etc.

(a) Closing condition

When the circuit-breaker is in the closing state, current flows from an upper terminal 62, through main electrodes 30 and a current collector 63, and to a lower terminal 64. Contact pressure on the main electrodes is maintained by a contact spring 65 which is attached to the insulation operator rod 61.

The main-electrode contact force, the force in a rapid-switch spring, and the electromagnetic force generated as a result of a short-circuit current are held by a support lever 66 and a prop 67. Upon exciting the closing coil when the circuit-breaker is in the breaking state, a plunger 68 raises a roller 70 through a knocking rod 69, thereby rotating a main lever 71 and closing the electrical contact. This condition is maintained by the support lever 66.

(b) Free pull-apart condition

A breaking operation causes the movable main electrode to move downwards and results in arc generation in the instant when the movable main electrode and the fixed main electrode are disconnected. The effect of high insulation and intense diffusion provided by the vacuum extinguishes the arc rapidly.

When a pull-apart coil 72 is excited, the pull-apart lever 73 releases its engagement with the prop 67, and the main lever 71 is rotated by the force in the rapid-switch spring to break the main electrodes. This is a free, mechanical pull-apart operation and is performed irrespective of the existence of a closing operation.

(c) Breaking condition

Subsequent to the opening of the main electrodes, links are restored to their original positions by a reset spring 74, and simultaneously, the prop 67 is engaged. When the closing coil 75 is excited in this condition, the mechanism returns to the closing condition described in (a) above. 76 denotes an exhaust pipe.

A vacuum circuit-breaker operates in a high vacuum and provides an excellent current breaking performance owing to the high insulation and high-speed arc diffusion action of the vacuum. When used to switch an unloaded electric motor or transformer, however, the breaker may break the current before it reaches zero, thereby causing a so-called cutting current to flow. This will cause a breaking surge voltage which is proportional to the product of the cutting current and the surge impedance. Thus, whenever a vacuum circuit-breaker is used to directly switch 3-kV transformers, 3-kV electric motors, or 6-kV electric motors, it will be necessary to incorporate a surge absorber in the circuit to control surge voltage and to protect the devices. Although condensers are usually used as surge absorbers, ZnO non-linear resistors may be used depending on the shock wave resistance voltage value for loading.

With the embodiment described above, it is possible to perform current breaking for 7.2 kV and for 31.5 kv with a pressure of 150 kg and a current breaking speed of 0.93 m/sec.

Figure 20:
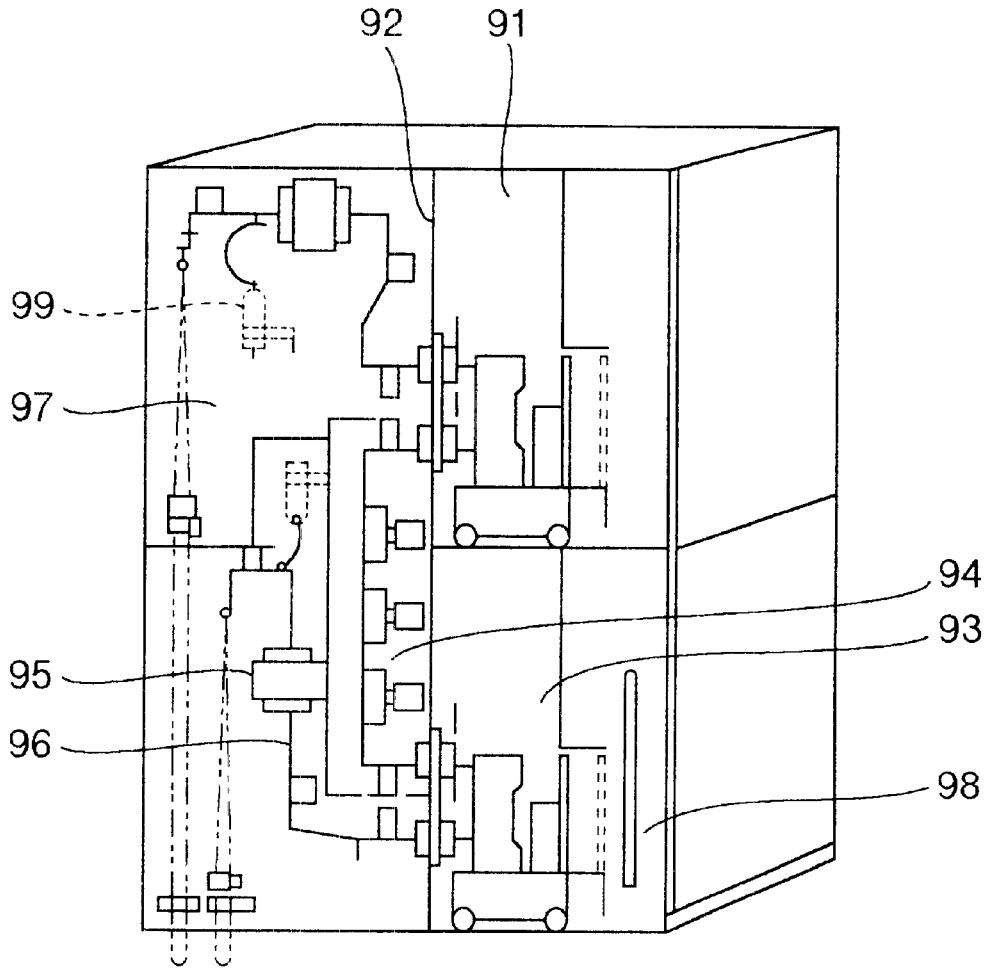
FIG. 20 is a schematic view showing the construction of a vacuum circuit-breaker, 2-level, stack switch gear.

FIG. 20 shows the internal construction of a vacuum circuit-breaker, 2-level, stack switch gear realized in accordance with the embodiment. 91 denotes an upper circuit-breaker compartment, 92 a metal-cladding frame compartment, 93 a lower circuit-breaker compartment, 94 a bus compartment, 95 a transformer, 96 a connection conductor, 97 a cable compartment, 98 a control service cable section, and 99 a surge absorber. Because of the three-phase power supply, three distinct circuit-breakers are used for one power source, and they are arranged in the direction perpendicular to the plane of the drawing.

This embodiment makes it possible to realize relatively smaller vacuum valves as compared with conventional vacuum valves for the same current breaking capacity. Accordingly, the electrodes themselves are reduced in size and the weight is lightened remarkably, thereby providing advantages that the operating mechanism becomes light to enable a precise operation, and the diameter of the electrodes can be made small to have a smaller volume of breaking gas between the electrodes.

The present invention enables electrical contacts of a desired shape to be obtained simply and in a short period of time, and a remarkable reduction in material and machining costs. Moreover, the electrical contact and the electrode rod are integrally bonded through sintering of the electrical contact, and therefore, no brazing material is required, such that operations of pre-assembling and brazing can be eliminated. Further, unlike the solid infiltration method, there is no solution or dispersion of the constituents of the electrical contact into the electrode rod side and the desired size of the electrical contact can be attained with consistency.

Moreover, operations or works for machining and assembling of respective elements, which are bonded through brazing in the conventional art, are no longer necessary, and electrode breakage or fall-off caused by brazing deficiencies is prevented. This contributes to improvement of the strength and prevents fusion damage resulting from electrode deformation. Additionally, as Pb or other low-melting-point metals can be included in the arc electrodes in large quantities, fusion can be prevented, and it is possible to realize smaller, reliable, and safe vacuum circuit-breakers, vacuum valves used therein, and electrodes thereof.

What is claimed is:

1. An electrode for a vacuum circuit breaker produced by the process of:

pressure-forming one of an alloy powder of a refractory metal and a highly conductive metal and a powder mixture of a refractory metal powder and a highly conductive powder into a compact in a shape having vanes separated by slit grooves and a central recess;

forming, from one of a highly conductive metal and a highly conductive alloy, an electrode rod having a protrusion on a central axis thereof;

coupling the electrode rod to the compact by fitting the protrusion of the electrode rod into the recess of the compact; and heating the compact and the electrode rod to a temperature below a melting point of the highly conductive metal to sinter the compact into an electrical contact and metallurgically bond the electrical contact and the electrode rod.

2. The electrode according to claim 1, wherein said compact further includes a highly conductive metal powder formed in a layer, and said one of the alloy powder of the refractory metal and the highly conductive metal and the powder mixture of the refractory metal powder and the highly conductive powder is formed in another layer lying on said layer of the highly conductive metal powder.

3. The electrode according to claim 1, further comprising a reinforcing plate of stainless steel disposed between said compact and said electrode rod, said reinforcing plate being fixed to a rear side of the electrical contact by the heating of the compact and the electrode rod.

4. The electrode according to claim 1, wherein a formation pressure for said compact is 1.5 ton/cm$^2$ to 4 ton/cm$^2$.

5. The electrode according to claim 1, wherein said refractory metal is one of Cr, W, Mo, Ta, Nb, Be, Hf, Ir, Pt, Zr, Ti, Te, Si, Rh, Ru, a mixture of two or more of Cr, W, Mo, Ta, Nb, Be, Hf, Ir, Pt, Zr, Ti, Te, Si, Rh and Ru, and a compound of one or more of Cr, W, Mo, Ta, Nb, Be, Hf, Ir, Pt, Zr, Ti, Te, Si, Rh and Ru, and said highly conductive metal is one of Cu, Ag, Au and an alloy having a main constituent of one or more of Cu, Ag and Au.

6. The electrode according to claim 1, wherein said one of the alloy powder of the refractory metal and the highly conductive metal and the powder mixture of the refractory metal powder and the highly conductive powder contains 15% to 40% by weight of the refractory metal and 60% to 85% by weight of the highly conductive metal.

7. The electrode according to claim 1, wherein a particle size of said one of the alloy powder of the refractory metal and the highly conductive metal and the powder mixture of the refractory metal powder and the highly conductive powder is 104 $\mu$m or less.

8. The electrode according to claim 1, wherein a tolerance of fitting of said protrusion on the electrode rod into said recess in the compact is 0.5% to 4% of a dimension of the recess when the particle size of said one of the alloy powder and the powder mixture is between 61 $\mu$m and 104 $\mu$m, and 1.5% to 9% when the particle size is 60 $\mu$m or less.

9. The electrode according to claim 1, wherein said electrical contact and said electrode rod, after metallurgical bonding, have a pull-apart strength of 200 kgf or more in a direction of fitting.

10. A vacuum valve having an insulating container and a pair of stationary and movable electrodes disposed in said insulating container, each of said stationary and movable electrodes comprising the electrode according to claim 9.

11. A method of manufacturing an electrode for a vacuum circuit breaker, comprising the steps of:

pressure-forming one of an alloy powder of a refractory metal and a highly conductive metal and a powder mixture of a refractory metal powder and a highly conductive powder into a compact in a shape having vanes separated by slit grooves and a central recess;

forming, from one of a highly conductive metal and a highly conductive alloy, an electrode rod having a protrusion on a central axis thereof;

coupling the electrode rod to the compact by fitting the protrusion of the electrode rod into the recess of the compact; and heating the compact and the electrode rod to a temperature below a melting point of the highly conductive metal to sinter the compact into an electrical contact and metallurgically bond the electrical contact and the electrode rod.

12. The method according to claim 11, further comprising the steps of adding a highly conductive metal powder into the compact while forming the highly conductive metal powder in a layer, and forming the one of the alloy powder of the refractory metal and the highly conductive metal and the powder mixture of the refractory metal powder and the highly conductive powder in another layer lying on the layer of the highly conductive metal powder.

13. The method according to claim 11, further comprising the step of disposing a reinforcing plate of stainless steel between the compact and the electrode rod, the reinforcing plate being fixed to a rear side of the electrical contact by the heating of the compact and the electrode rod.

14. The method according to claim 11, wherein a formation pressure for said pressure-forming step is 1.5 ton/cm$^2$ to 4 ton/cm$^2$.

15. The method according to claim 11, wherein a tolerance of fitting of the protrusion on the electrode rod into the recess in the compact is 0.5% to 4% of a dimension of the recess when the particle size of the one of the alloy powder and the powder mixture is between 61 $\mu$m and 104 $\mu$m, and 1.5% to 9% when the particle size is 60 $\mu$m or less.

* * * * *

UNITED STATES PATENT AND TRADEMARK OFFICE

CERTIFICATE OF CORRECTION

PATENT NO. : 6,437,275 B1
DATED : August 20, 2002
INVENTOR(S) : S. Kikuchi et al.

It is certified that error appears in the above-identified patent and that said Letters Patent is hereby corrected as shown below:

Title page,
Item [30], please insert Foreign Application Priority Data to read as follows:

-- [30] Foreign Application Priority Data
Nov. 14, 1997 (JP) . . . . . 9-313105
Aug. 31, 1998 (JP) . . . . . 10-244695 --

Signed and Sealed this

Twenty-sixth Day of November, 2002

*Attest:*

*Attesting Officer*

JAMES E. ROGAN
*Director of the United States Patent and Trademark Office*